US011248365B2

(12) United States Patent
Asada et al.

(10) Patent No.: US 11,248,365 B2
(45) Date of Patent: Feb. 15, 2022

(54) AUTOMATED CONTROL FOR EXCAVATORS

(71) Applicant: Massachusetts Institute of Technology, Cambridge, MA (US)

(72) Inventors: Haruhiko Harry Asada, Lincoln, MA (US); Filippos Edward Sotiropoulos, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 302 days.

(21) Appl. No.: 16/412,295

(22) Filed: May 14, 2019

(65) Prior Publication Data

US 2020/0024828 A1 Jan. 23, 2020

Related U.S. Application Data

(60) Provisional application No. 62/702,056, filed on Jul. 23, 2018.

(51) Int. Cl.

| | |
|---|---|
| ***E02F 9/20*** | (2006.01) |
| ***E02F 3/32*** | (2006.01) |
| ***E02F 3/43*** | (2006.01) |

(52) U.S. Cl.

CPC ..... *E02F 9/2041* (2013.01); *E02F 3/32* (2013.01); *E02F 3/439* (2013.01); *E02F 9/205* (2013.01)

(58) Field of Classification Search

CPC . E02F 9/2041; E02F 3/32; E02F 9/205; E02F 3/439; E02F 3/437

See application file for complete search history.

(56) References Cited

U.S. PATENT DOCUMENTS

| | | | | |
|---|---|---|---|---|
| 5,065,326 | A | 11/1991 | Sahm | |
| 5,160,239 | A | 11/1992 | Allen et al. | |
| 6,487,797 | B1 | 12/2002 | Inoue et al. | |
| 2008/0097672 | A1* | 4/2008 | Clark | E02F 9/2029 701/50 |
| 2014/0107841 | A1* | 4/2014 | Danko | B25J 9/1651 700/253 |
| 2018/0174291 | A1* | 6/2018 | Asada | G06T 7/97 |

FOREIGN PATENT DOCUMENTS

WO WO 2005/103396 A1 11/2005

OTHER PUBLICATIONS

International Search Report and Written Opinion dated Jul. 22, 2019 in connection with International Application No. PCT/US2019/032172.

* cited by examiner

*Primary Examiner* — Russell Frejd

(74) *Attorney, Agent, or Firm* — Wolf, Greenfield & Sacks, P.C.

(57) ABSTRACT

Methods and systems related to operating an excavator during a digging cycle are described. In some embodiments, a nominal path of a bucket connected to one or more linkages of the excavator may be commanded. A correction to the commanded nominal path may be applied to maximize a power applied by at least one of the one or more linkages of the excavator during at least a portion of the digging cycle.

30 Claims, 22 Drawing Sheets

AUTOMATED CONTROL FOR EXCAVATORS

CROSS-REFERENCE TO RELATED APPLICATIONS

This application claims the benefit under 35 U.S.C. § 119(e) of U.S. provisional application Ser. No. 62/702,056, filed Jul. 23, 2018, the disclosure of which is incorporated by reference in its entirety.

FIELD

Disclosed embodiments are related to automated control for excavators.

BACKGROUND

Excavation machinery is pervasive across many industries such as construction, infrastructure work, and mining. The operation of such machines is undertaken by skilled operators who become experts at performing the various tasks by harnessing the full capabilities of the machine. Despite the high demand for trained operators there is a distinct shortage of highly capable operators since acquiring the appropriate training requires significant time and practice. Furthermore, the often times harsh and remote working conditions may make these jobs particularly arduous and unappealing. The harsh working environments may also induce worker fatigue, leading to reduction in productivity and work quality. Accordingly, various control techniques have been applied in an attempt to provide autonomous excavators. However, automating excavation processes presents several unique challenges which are largely absent from traditional manufacturing and industrial robotics applications. Specifically, excavation deals with manipulating soil and rocks which is distinctly more complex that typical manipulation of discrete objects and interfaces. The shape and characteristics of the environment are unstructured and exhibit non-uniform, time varying, and highly nonlinear properties. Thus, it has been difficult to date to emulate or replace the sophisticated decision making that an operator undertakes for a wide set of situations.

SUMMARY

In one embodiment, a method of operating an excavator during a digging cycle includes: commanding a nominal path of a bucket connected to one or more linkages of the excavator; and apply a correction to the commanded nominal path to maximize a power applied by at least one of the one or more linkages during at least a portion of the digging cycle.

In another embodiment, an excavator includes a bucket and one or more linkages operatively coupled to the bucket. The one or more linkages include one or more associated actuators. Additionally, the excavator may include one or more sensors configured to detect one or more operating parameters of the one or more linkages during a digging cycle as well as a processor operatively coupled to the one or more actuators and the one or more sensors. The processor is configured to command a nominal path of the bucket during a digging cycle and apply a correction to the commanded nominal path to maximize a power applied to the at least one of the one or more linkages during at least a portion of the digging cycle.

In yet another embodiment, a method of operating an excavator during a digging cycle includes: commanding a nominal path of a bucket connected to one or more linkages of the excavator, wherein the commanded nominal path of the bucket passes through a first region with a first soil property and a second region with a second soil property different from the first soil property; applying a first correction to the commanded nominal path to maximize a power applied by the one or more linkages of the excavator when the bucket passes through the first region; and applying a second correction to the commanded nominal path to maximize the power applied by the one or more linkages of the excavator when the bucket passes through the second region.

In still another embodiment, an excavator includes a bucket, one or more linkages operatively coupled to the bucket, one or more actuators associated with the one or more linkages, one or more sensors configured to detect one or more operating parameters of the one or more linkages during a digging cycle, and a processor operatively coupled to the one or more actuators and the one or more sensors. The processor is configured to maximize a power applied by at least one of the one or more linkages during at least a portion of the digging cycle. When the bucket passes through a first region with a first soil property the processor is configured to apply a first correction to a commanded nominal path of the bucket to maximize the power applied in the first region. When the bucket passes through a second region with a second soil property different from the first soil property the processor is configured to apply a second correction to the commanded nominal path of the bucket to maximize the power applied in the second region.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
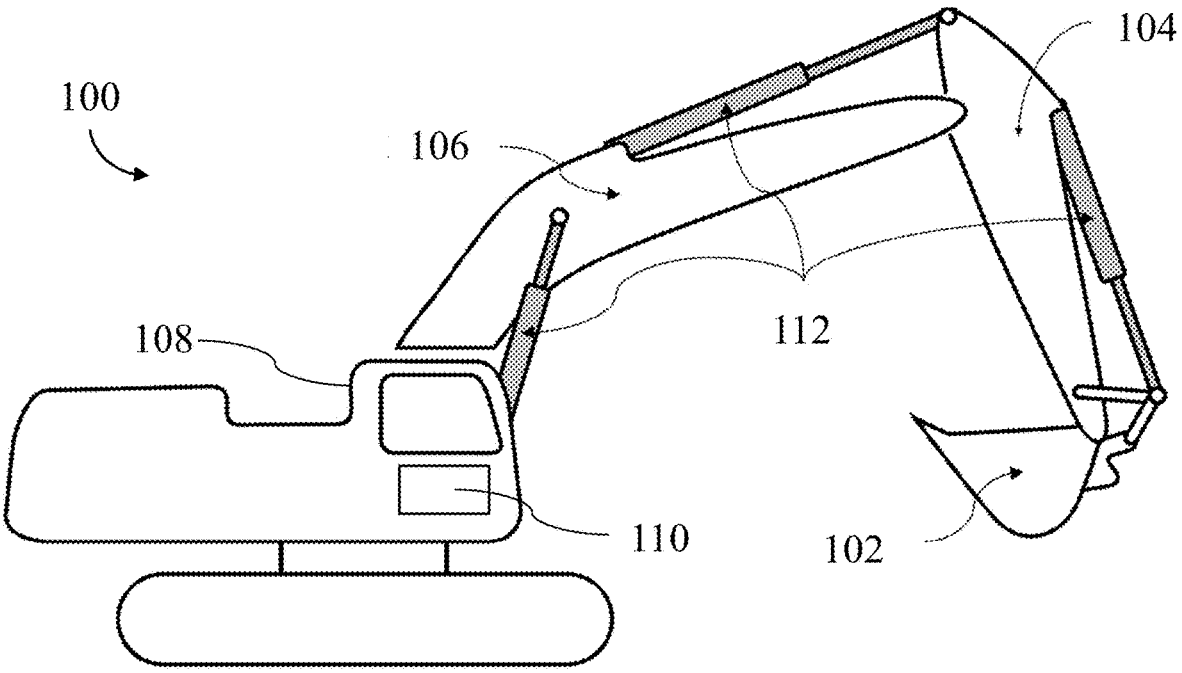
FIG. 1A is a schematic of an excavator.

Despite various research efforts over the last three decades, efforts at automating excavation processes have fallen short of providing an adequate replacement for the efficacy and versatility of a well-trained human operator. Based on interviews with operators, the Inventors have recognized that there are two main factors which are considered by expert human operators. These include the filling of the bucket (i.e. how quickly the bucket is filled and if a target bucket filling is reached) and controlling the resistance force between the bucket and soil. Therefore, the expert operator regulates the trajectory so that the relation between velocity and excavator effort is optimal. For example, a trajectory where the excavator faces very high resistance and moves very little and gets stuck, or the converse where there is very little resistance at all and the excavator moves too easily through soil, are both undesirable as they do not fully utilize the power capabilities of the excavator to alter the soil in a desirable way. Furthermore, by maintaining an appropriate power output for an excavator it may be possible to avoid overloading the machine, taking excessive time to execute a digging cycle, and avoid getting the excavator arm stuck which may result in the arm needing to execute a resetting motion.

In view of the above, the Inventors have recognized the benefits associated with maximizing a power applied by one or more linkages of an excavator attached to an associated bucket during at least a portion of a digging cycle. For example, in one embodiment, a nominal path of a bucket connected to the one or more linkages of the excavator may be initially commanded. A correction to the commanded nominal path may be applied to increase, and in some embodiments maximize, a power applied by at least one of the one or more linkages during at least a portion of a digging cycle. For instance, one or more sensors of the excavator may be configured to detect operating parameters related to a power applied to at least one of the one or more linkages and/or a velocity of at least one of the one or more linkages during a digging cycle. Thus, the one or more sensors may detect variations in these operating parameters as the one or more linkages are actuated by one or more associated actuators to apply the commanded path to an operatively coupled bucket of the excavator. Based on feedback from the sensed one or more operating parameters, the correction may be applied to the commanded nominal path to increase, and in some instances maximize, a power output by one or more desired linkages during at least a portion of the digging cycle.

The power output from one or more linkages of an excavator arm may be increased and/or maximized in a number of different ways. However, in one embodiment, a gradient of the power output from at least one of the one or more linkages with velocity of at least one of the one or more linkages may be determined. This gradient may then be used to appropriately control one or more operating parameters of the associated linkage to increase and/or maximize the output power of that linkage during operation. For example, the velocity, depth of cut, angle of attack of an associated bucket, and/or any other appropriate operating parameter of the linkage may be appropriately changed based on the determined gradient to increase, and in some embodiments maximize, the applied power applied by the linkage during at least a portion of a digging cycle.

It should be understood that the above-noted gradient of power with velocity of a linkage of interest may be determined in any appropriate fashion. In one such embodiment, a velocity of the commanded nominal path of at least one of the linkages associated with an operatively coupled bucket may be varied with time, i.e. a dither may be applied to the commanded path. A power output by the associated linkage may be monitored during this variation to determine the gradient of power with velocity. Any appropriate type of variation may be applied including, for example, a dither such as a cyclic sine wave of a desired amplitude and frequency may be applied to the commanded path. However, other appropriate cyclic variations may be applied as the disclosure is not limited to only application of a sine wave. Additionally, in another embodiment, random or stochastic variations may be applied to the commanded path to determine the gradient of power with velocity. In yet another embodiment, natural variations in a linkage's output power and velocity during operation may be detected due to variations in soil properties naturally resulting in variations in an actual path versus a commanded path of a bucket. Accordingly, these variations may again be used to determine a gradient of power with velocity for a desired linkage associated with a bucket of an excavator. Thus, it should be understood that a gradient of power with velocity may be determined for one or more portions of an excavator system in any number of ways, and the current disclosure should not be limited to any particular method of determining such a gradient which may then be subsequently used to alter a commanded path to increase the applied power of one or more linkages of an excavator's arm.

In the above embodiments, operating one or more linkages associated with a bucket to maximize power output of at least one of those linkages is described. However, as elaborated further in the examples, the Inventors have recognized that maximizing the power output of particular linkages of an excavator during certain portions of a digging cycle may be especially beneficial. For example, the Inventors have recognized that during a dragging phase of a digging cycle, a majority of the power output and motion control applied by expert operators is applied by an arm linkage of an overall excavator arm which may also be known by other terms such as a stick, dipper arm, arm linkage, or other appropriate term. In either case, the Inventors have recognized that increasing, or maximizing, a power output of an arm linkage of an excavator arm during at least a portion of a digging cycle, including during a dragging portion of a digging cycle, may be desirable. Accordingly, in some embodiments, the described one or more linkages which are being controlled to maximize a power output may include maximizing a power output of the arm linkage of the overall excavator arm. However, embodiments in which multiple linkages and/or different linkages of an excavator arm are operated to maximize power output during one or more portions of a digging cycle are also contemplated. For example, a boom, arm, bucket, combinations of the foregoing, and/or any other appropriate linkages of an overall excavator arm may be operated in the described fashion as the disclosure is not limited in this fashion.

Due to the large number of variations in possible excavator configurations and operations, the terms power and velocity of an associated linkage have been described generally. However, it should be understood that the various linkages described herein rotate relative to each other. Therefore, the described velocities may refer to either a rotational velocity of the linkages and/or a linear velocity of a portion of the linkages such as a distal end of the linkage Additionally, it should be understood that this type of parameter may be detected and/or used in the described calculations indirectly. For example, in hydraulic systems, a power and/or velocity of a system may be monitored using pressure and/or flow sensors associated with an actuator operatively coupled to the linkage. In one such embodiment, these sensors may measure velocities and pressures applied to a piston of the actuator. Alternatively, in electrical systems current sensors and position encoders may be used to indirectly measure applied forces and velocities. Accordingly, it should be understood that any appropriate way of either directly and/or indirectly monitoring and controlling the desired operating parameters of an excavator during a digging operation may be used as the disclosure is not limited in this fashion. Appropriate types of sensors may include, but are not limited to, force transducers, current sensors, accelerometers, velocity encoders, pressure transducers, flow sensors, position encoders, and/or any other appropriate sensor capable of detecting a desired operating parameter of one or more linkages of an overall excavator arm.

In view of the above, an excavator may be controlled using what may be considered to be a model-free method where the capabilities of the excavator may be optimally harnessed by matching its internal characteristics to those of the environment. By maximizing the power output of specific actuators, the machine may be able to strike a balance between disadvantageous operating conditions where it is either getting stuck in the soil or simply not utilizing its full potential to move soil towards task-oriented goals. Thus, the disclosed methods and systems may search locally for the correct direction to travel in, and move in the direction, which improves performance using one or more desired metrics such as power in one case. The model-free approach may be particularly suitable for soil excavating applications as it forgoes the development and use of complicated models for soil behavior which may likely be too computationally expensive for realistic real-time applications. As elaborated on in the examples below, such a power maximization strategy for path adaptation for excavation is both well-grounded and feasible.

Without wishing to be bound by theory, from an engineering/quantitative perspective the problem of determining an operation condition where a system can avoid reaching the extremes in an inversely related effort-to-flow relation can be framed as an impedance matching problem. Mechanical impedance is defined as the ratio of force applied to a system to velocity observed at that point. When a system is doing work to another system, as an excavator does to the soil, then the impedance difference between the two systems dictates how effectively power is being transferred from one system to the other. If the impedance of the soil is very high compared to that of the excavator, then for a given force exerted by the excavator there is a very small velocity response in the system. When the soil system has a very low impedance the excavator moves with little effort through the soil. Both these extremes may result in low power transmission to the soil meaning that there is low utilization of the machine capabilities. In contrast, when the impedance of the soil is approximately equal to that of the excavator the transmitted power to the soil may be maximized and so the excavator may perform a maximum amount of work on the soil as well. Thus, from discussions with and observations of expert operators, it is believed that an expert operator unknowingly is attempting to track an excavation path which leads the soil impedance observed at the bucket to match the inherent impedance of the machine.

An important aspect to note in the disclosed embodiments is that as compared to a trajectory tracking controller, where each degree of freedom is prescribed a desired position and velocity to track, here one or more of the joints (e.g. the arm) has a speed which is not actively controlled. The speed of that joint may instead arise from the interaction between the characteristics of the machine and the soil load to maximize power output as previously described. Hence if a particular path (including deviations due to extremum seeking) is to be followed, then the trajectory of the boom and bucket motion may take into account the actual speed of the arm. As the optimization from extremum seeking is performed in joint space, this trajectory adaptation may also be performed in joint space to maintain desired operation of the overall excavator arm during a digging cycle. To provide a desired trajectory for the controller to follow from the path, in one embodiment, a point on the path corresponding to the current arm location may be determined. Then the new desired velocity may be that of the original trajectory (including any correction and perturbation which is the tangent to the curve of the path) scaled so that the component of the trajectory in the arm direction equals the current arm speed. The desired velocity now goes to the low-level controller. The specifics of this are related to whatever the specific machine or simulation is being implemented. Clearly applying this algorithm to a hydraulic system compared to an electric excavator may use different controls for the actuator positioning.

One of the main drawbacks of extremum seeking control methods is that due to the time-scale separation, convergence times may tend to be relatively long. Accordingly, in some embodiments, proportional-integral extremum seeking may be applied to seek a maximum power for operation of a linkage. In such a method, classic extremum seeking may be altered by modifying the applied adaptation law, which typically includes only a scaled integration of the local gradient of the performance metric with respect to the tunable parameter, to include a proportional term. Such a modification is expected to accelerate the transient response of the linkage correction.

As an alternative to the above, in other embodiments, another possibility for improving the transient response, may include combining the disclosed methods and systems with heuristic/programmed control actions in response to power measurements. For example, combining the extremum seeking with a model-based approach may also yield a faster convergence rate. This may allow the disclosed systems to be more flexible in unexpected situations such as hitting a solid obstacle where extremum seeking may not allow the bucket to free itself. In this case incorporating control actions which are more heuristic in nature may be useful.

It should be appreciated that the above discussion may also be applicable to situations in which an excavator encounters multiple soil types of varying soil properties in the course of a single trajectory. For example, algorithms that seek to maximize power may still be executed even as an excavator transitions from a first region with a first soil property to a second region with a second soil property different from the first (e.g. transitioning from a soft soil to a hard soil). Due to the model-free nature of the above methods, the algorithms may respond automatically and continuously to changes in soil conditions to maximize power output from the associated linkage in both regions without any additional input from an operator. Consequently, a commanded path may change as a bucket transitions between different soil conditions, as different paths may be required to maximize power in different soil conditions. Further, the change in the commanded path between these two regions with different soil properties may result in the linkage applying corresponding first and second maximum powers. Depending on the particular soil properties and system operation, these first and second powers may be approximately the same, and may in some instances, correspond to approximately a maximum power output of the linkage. However, embodiments in which the first and second maximum powers may be different from one another are also contemplated.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

In some embodiments, an excavator may include an overall excavator arm that includes, a boom 106, an arm 104, and a bucket 102, as shown in FIG. 1A. The boom is operatively coupled to a body 108 of the excavator such that it can be pivoted about a joint connected to the body. Correspondingly, the arm is operatively coupled to the boom such that it can be pivoted about a joint between the arm and boom. Similarly, the bucket is operatively coupled to the arm such that it can be pivoted about a joint between the arm and bucket. These individual linkages can be operated to create a desired range of movements and orientations of the bucket along a commanded path. Specifically, a controller 110 of the excavator may be operatively coupled with one or more actuators 112 coupled to each of the separate linkages for controlling operation of the actuators, and thus, movement of the linkages relative to each other and the excavator body. For example, an actuator extending between the body and boom controls orientation of the boom relative to the body, an actuator extending between the boom and arm controls orientation of the arm relative to the boom, and an actuator extending between the arm and the bucket controls orientation of the bucket relative to the arm. In some embodiments, the actuators may include sensors, not depicted, that may transmit signals to the controller regarding one or more operating parameters of the actuators. In the figure, the actuators are depicted as cylindrical hydraulic actuators. However, it should be understood that the actuators may correspond to any appropriate actuator capable of controlling movement of a linkage including, but not limited to, various linear actuators, rotational actuators, hydraulic actuators, electrical actuators, pneumatic actuators, combinations of the foregoing, and/or any other appropriate type of actuator as the disclosure is not limited in this fashion.

Figure 1B:
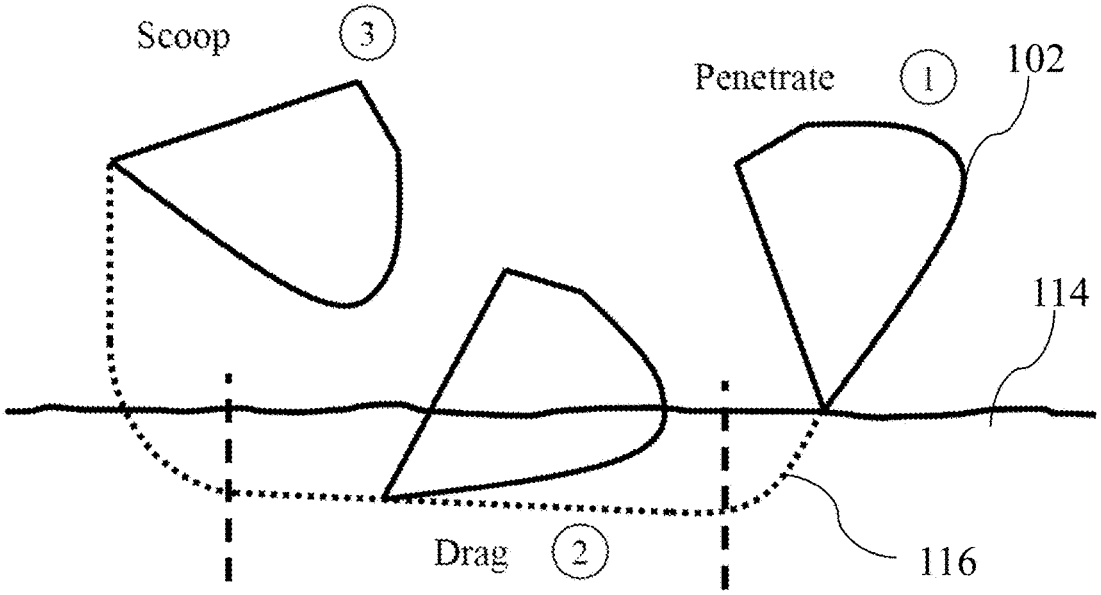
FIG. 1B is a schematic showing phases of a digging cycle.

There are distinct phases in a digging cycle as a bucket follows a desired digging path 116, which, as shown in FIG. 1B, may include (1) penetration of a bucket 102 into the soil 114, (2) dragging of the bucket across a soil face, and (3) final scooping of the bucket. The final soil in the bucket is primarily influenced by the shape of soil just before scooping and the scooping motion. During this stage of digging the primary focus is successfully scooping soil into the bucket. The soil which is gathered in front of the bucket at that stage is determined by the previous trajectory. During the dragging motion on the other hand the bucket is mainly moving the soil to soften it and accumulate it in front of the bucket. Here the main consideration is moving effectively through the soil and is where maximizing power applied to the soil by the one or more linkages (i.e. the boom, arm, and bucket) may be of use.

As stated previously a control objective may be framed as matching the characteristics of a machine with an environment so as to operate at a state where maximum work done is on the environment. The operating trajectory for which this is achieved may depend on the machine internal characteristics as well as site factors such as soil type, fragmentation and site shape.

Extremum seeking control (ESC) is a method in control theory that allows for controlling a system towards the extremum (maximum or minimum) points of a state-to-output mapping. In the disclosed embodiments this mapping may reflect the relation between the excavator states and the transmitted power or impedance disparity at the bucket. Methods taken from extremum seeking may thus be harnessed to make the excavator follow trajectories for maximizing power transmission to the environment.

Figure 2:
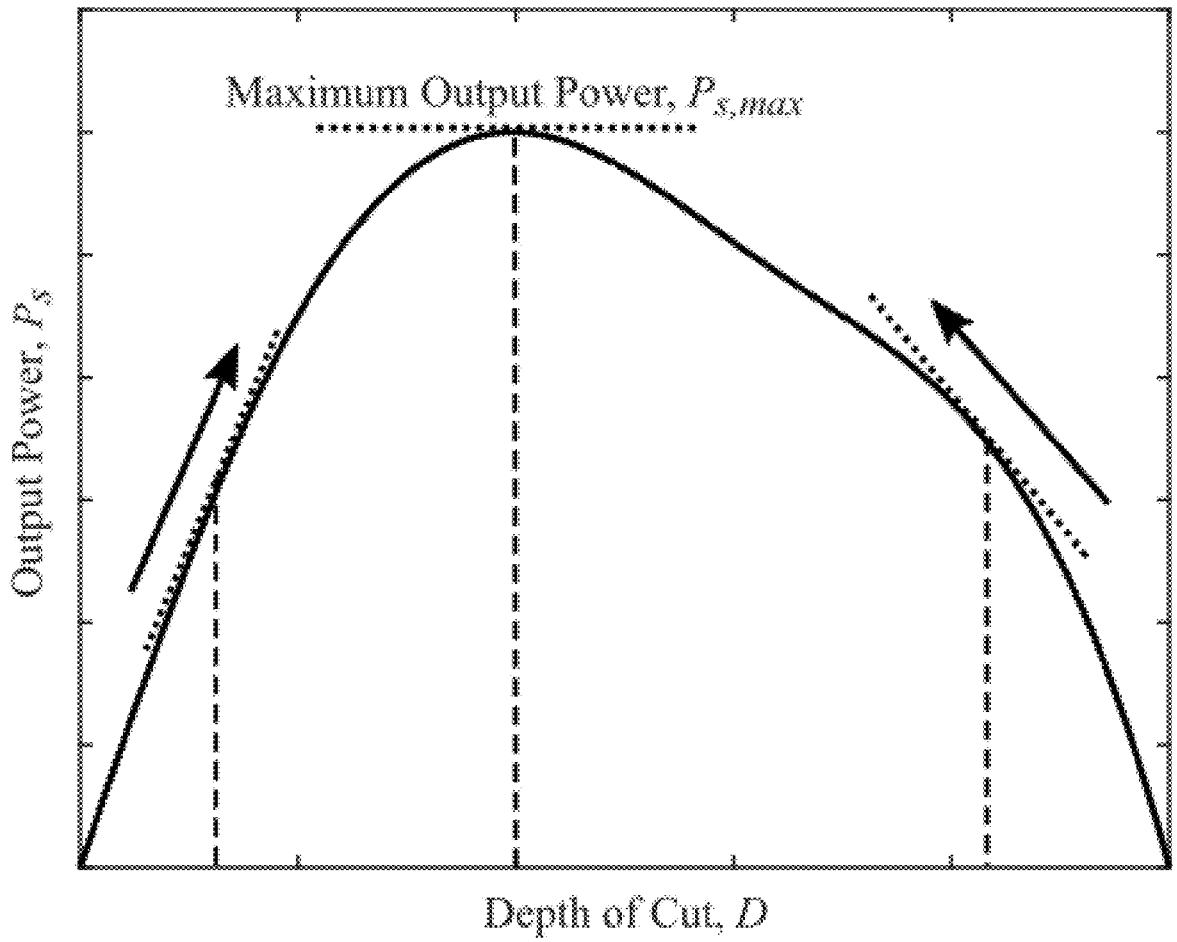
FIG. 2 is a representative plot of excavator output power as a function of depth of cut.

FIG. 2 shows a representative plot of output power $P_s$ as a function of depth of cut D. As noted previously, a deeper cut may result in increased forces being applied at reduced speed, and in extreme cases may result in the bucket becoming stuck. Conversely, shallower cuts may result in faster digging speeds and reduced forces as the bucket easily moves through a small amount of material. However, in between these two extremes the power may increase towards as the applied cut depth approaches a cut depth where the power is maximized as shown in the figure. Therefore, in some embodiments, optimal dragging may be achieved by seeking the peak of the output power by controlling a depth of cut in addition to, or as an alternative to, controlling a velocity or other operating parameter of a given linkage. In one such embodiment, ESC, or another appropriate control method, may estimate a gradient of the output power curve, and may control the depth of cut in a direction to increase, and/or maximize, the output power.

Figure 3:
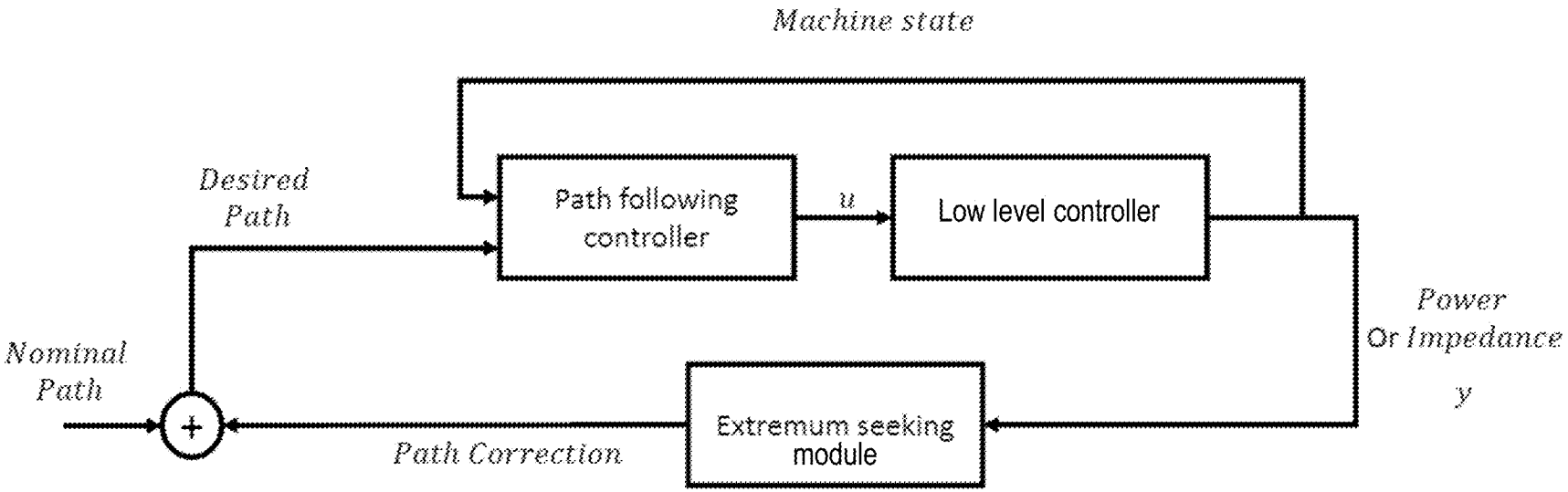
FIG. 3 depicts a control block diagram of one embodiment for maximizing power output during an excavator digging cycle.

FIG. 3 presents an overview of a general control scheme with subsequent subsections detailing the specific elements in more detail. The figure shows a block diagram scheme illustrating the primary components of a control algorithm. As can be seen, apart from the plant, there are three distinct sub-modules of the algorithm which can largely be addressed separately. These are the extremum seeking module which estimates the local gradient of the input-output mapping and outputs a deviation to the trajectory, the path following controller which converts a correction to the nominal path determined by the extremum seeking part to a time constrained trajectory, and lastly the low-level controller which may apply the commanded motion to the associated linkages of the excavator arm. During operation, a nominal path may be commanded and fed into the path following controller which may then output the appropriate command to the low-level controller. The power and/or impedance versus a desired operating parameter such as linkage or joint velocity may then be fed into the extremum seeking portion of the control algorithm which may then determine an appropriate path correction to increase in applied power of the linkage or joint. This path correction may then be added to the nominal path to determine a desired path with an increased power. This desired path may then be fed back into the path following controller which may then appropriately command the desired path using the input desired path and the current machine state as determined using any appropriate combination of sensors.

Figure 4:
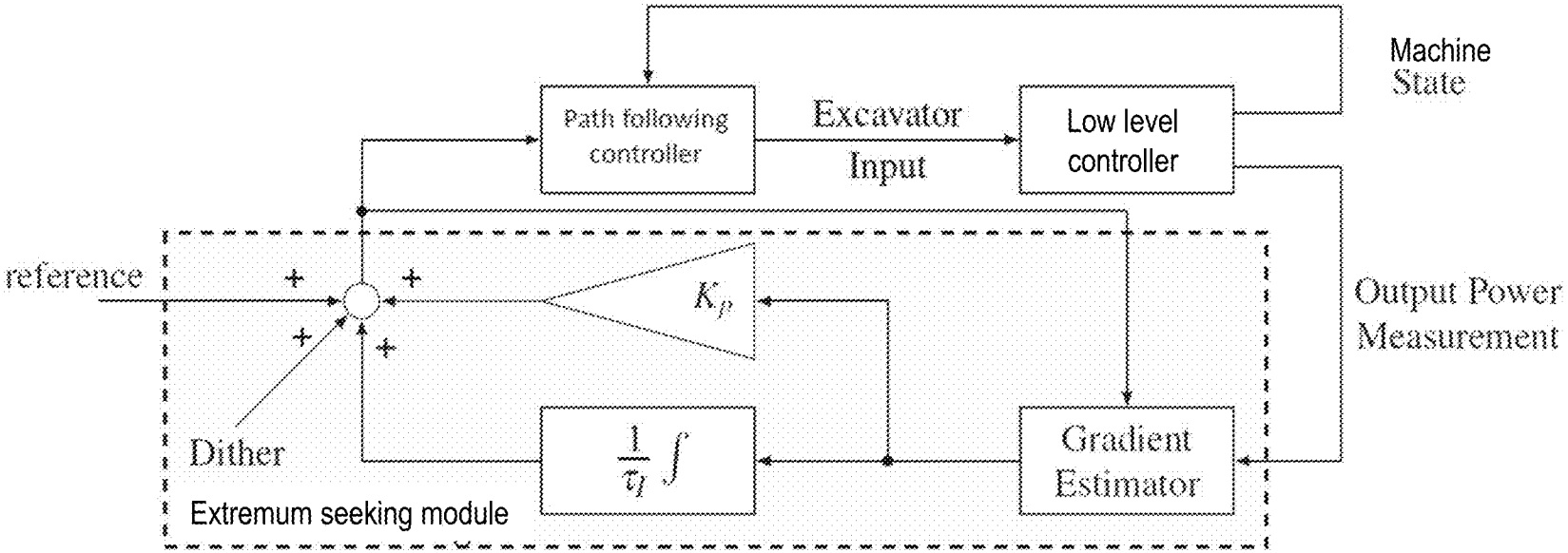
FIG. 4 depicts a control block diagram of one embodiment for maximizing power output during an excavator digging cycle.

FIG. 4 presents, similar to FIG. 3, a general block diagram scheme illustrating components of a control algorithm including a path following controller, low level controller, and an extremum seeking module to maximize a power output of one or more linkages of the system. Specifically, FIG. 4 provides additional details of one embodiment of the extremum seeking" module. In the depicted embodiment, the extremum seeking module may include a gradient estimator that estimates the gradient of the output power curve with respect to one or more tunable trajectory parameters. After determining the gradient of power, the controller may control the depth of cut, velocity, or other parameter in a direction to increase and/or maximum the output power. The correction to the reference trajectory may be made using a proportional-integral adaptation law, represented in FIG. 4 by the proportional block with proportional gain $K_p$ and the integrator block with integral gain $1/\tau_1$. In some embodiments, a dither may be added to the corrected path trajectory which may help to avoid the system becoming stuck in a local power maximum. Of course, while the block diagram in FIG. 4 presents one possible implementation of extremum seeking, it should be understood that other implementations of extremum seeking control are contemplated and the disclosure is not limited to the implementation shown in FIG. 4.

Figure 5:
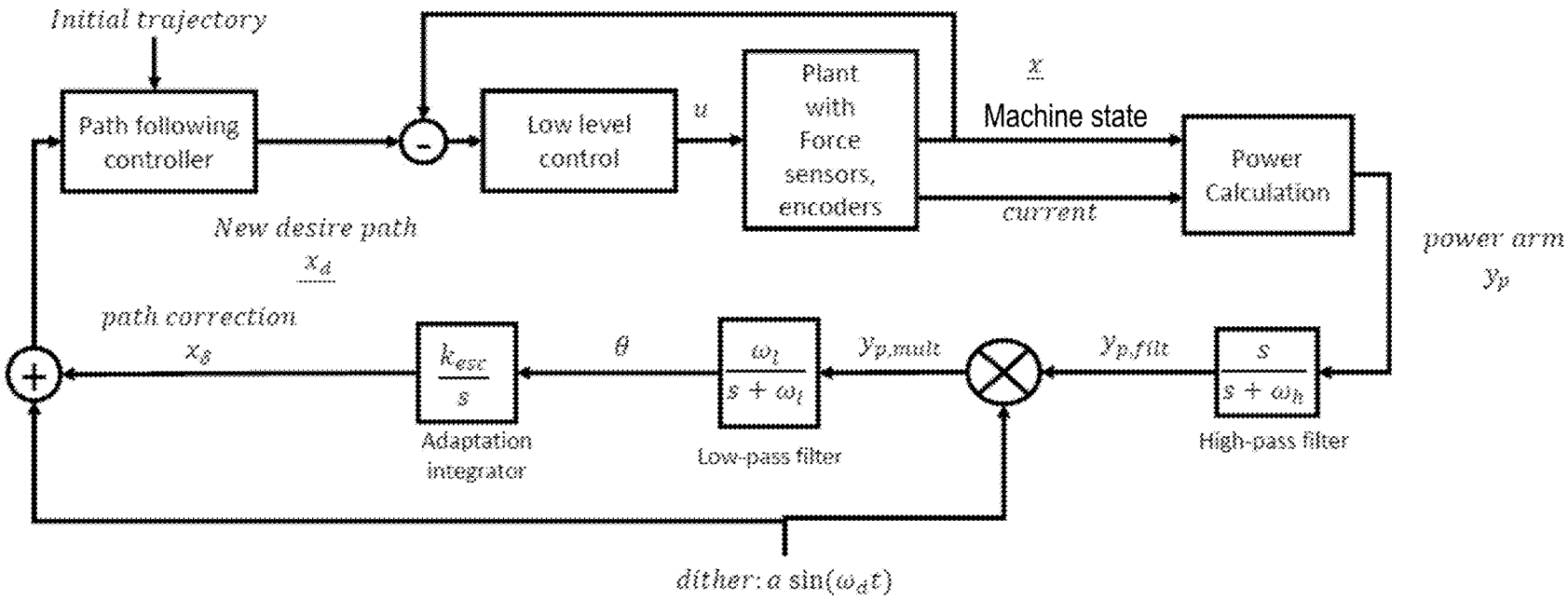
FIG. 5 depicts a control block diagram of one embodiment for maximizing power output during an excavator digging cycle.

FIG. 5 presents another embodiment of an excavator implementing extremum seeking control to maximize power. Similar to the above embodiments, the control system may include a path following controller which may be provided with an initial trajectory. The trajectory may be passed to a low level controller for commanding a path of one or more linkages of the excavator. The resulting machine state may be measured with appropriate sensors such as force sensors, pressure sensors, encoders, and/or any other appropriate sensor. As illustrated in this embodiment, a power calculation of the power output from the various linkages may be done using the sensed information. In this particular embodiment, the control algorithm may inject a perturbation, i.e. a dither, most commonly a sinusoid, additively to the nominal boom, arm, and/or bucket path being executed by the low-level controller. However, it should be understood that any appropriate form of perturbation may be applied to the nominal commanded path as the disclosure is not so limited. If the perturbation or dither is assumed to be slow compared the settling time of the system, then the inserted dither is followed faithfully. If the movement due to the perturbation causes the bucket to encounter a change in load impedance (for example due to change in depth) this in turn may cause the power through the arm cylinder to vary. The power signal which may be calculated from available effort and flow measurements may be fed through a high pass filter whose frequency response may be designed to remove the DC component of power leaving only the fluctuating power caused by the perturbation. Care may be taken to choose the cut off frequency of the filter to avoid any large phase shift in the varying power due to the applied perturbation. The filtered power signal ($y_{p,filt}$) may now be multiplied with the dither which is injected into the trajectory. Depending on the phase shift between the power and the dither the signal $y_{p,mult}$ may have a bias ranging from negative to positive depending on whether a change in the trajectory caused by the dither results in a positive or negative power change. This bias may be isolated by passing the signal through a low-pass filter. This signal represents an estimate of the local gradient of arm power with respect to changes in boom and/or bucket trajectory. The adaptation law based on this gradient may simply take the integral using any desired scaling. This calculated offset may then be added to the originally commanded path to provide a corrected path trajectory for the linkage to follow.

It should be understood that the above noted embodiment may be extended to optimizing the operation of more than one parameter including trajectories of multiple joints or linkages of an overall excavator arm (e.g. adding the bucket trajectory). This can be done simply by having the same loop replicated for each desired degree of freedom. However, when using a dither or other applied variation for these different degrees of freedom, it may be desirable to avoid interference in the detected signals. Thus, in some embodiments, the applied variations may either be orthogonal to each other in direction and/or applied at different frequencies for the different degrees of freedom.

Figure 6:
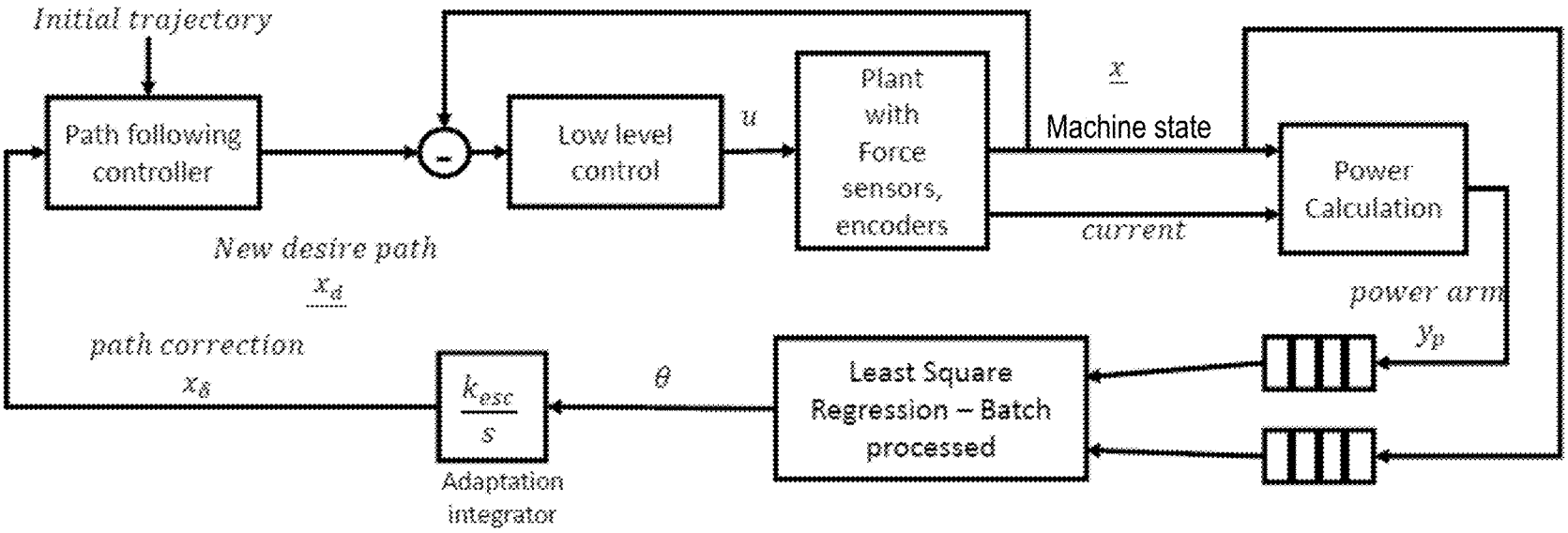
FIG. 6 depicts a control block diagram of one embodiment for maximizing power output during an excavator digging cycle.

As shown in FIG. 6, in some embodiments, it may be desirable to optimize the power of one or more joints of an excavator without applying a dither to estimate the local gradient. Similar to the above embodiments, the control system may include a path following controller which may be provided with an initial trajectory. The trajectory may be passed to a low level controller for commanding a path of one or more linkages of the excavator. The resulting machine state may be measured with appropriate sensors such as force sensors, pressure sensors, encoders, and/or any other appropriate sensor. As illustrated in this embodiment, no sinusoidal, or other form of, dither may be applied to the commanded path to excite variations in the commanded path. Instead, this method may rely on a discrete implementation where the power and trajectory are sampled, and the local gradient is estimated by looking at variations of the actual path versus the commanded path of the excavator arm. For example, as shown in the figure, in one specific embodiment, the actual path may be evaluated using a linear regression based on minimizing the least squares error. In one embodiment, each of the signals may be stored in a buffer of length $N_{buffer}$ and the local gradient estimate may be evaluated on the linear regression of these buffers. Using the calculated local gradient, the adaption integrator may be used to determine and apply a path correction to the initial commanded path as described above for the classical extremum seeking case.

In the above embodiment, the described algorithm uses a buffer of the position of the machine and the corresponding power output. Accordingly, in some embodiments, the algorithm may be initialized during a non-stationary operating mode so that a buffer can accumulate some non-collinear data from which to derive a gradient.

Example: Methodology and Experimental Excavator Considerations

During experimentation and development, control of an excavator was initially limited to motion of the boom, stick and bucket excluding motion of the swing and treads. This restricted motion to a single plane. For these experiments, it was decided to match the impedance of the machine and that of the load (soil), and thus maximize power. However, this still allowed for various possible variants to be used.

Without wishing to be bound by theory, impedance is simply the ratio of effort (force, pressure etc.) to flow (speed, flow rate etc.) at a given time. And the power being transmitted at this point is conversely the product of the effort and flow. For an excavator this could be taken at a series of different locations. The most apparent given the problem at hand is at the point where the bucket interacts at the soil. Here the impedance of the machine elements is reflected through the various actuators and kinematics of the linkages to the bucket. This has the advantage of taking into consideration the total aggregation of the machine characteristics at the end effector. On the other hand, this may pose some limitations in practical implementation. In particular, measuring force at the end effector may be impractical in real world machinery. The other extreme of this would be to use measurements taken close to the source of power of the machine (i.e. measurements of pressure and flow at the hydraulic pump). The problem with such an implementation would be that the variation in the soil load would be mixed with other internal loading sources such as swing, track movement, and auxiliary power. Furthermore, the low back-drive-ability of the hydraulics means that the fidelity of inferring load characteristics from internal measurements may be limited. The third option is that of taking an intermediate approach. In these experiments, the efforts and flows at the piston level were considered. Specifically, by measuring pressures and flow rates into pistons, or forces and velocities, it was possible to calculate the impedances and/or power through the location. Furthermore, it allowed for flexibility in what the metric can represent as the power from multiple or single pistons can be optimized for. Of course, while a particular implementation has been used in these experiments, it should be understood that any appropriate combination of sensor inputs may be used for determining the power of a desired linkage as the disclosure is not limited to only this implementation.

Based on analysis of true excavator data it was observed that when an expert operates the excavator, the large majority of the power output is from the arm cylinder. Considering this it may be adequate to simply consider power of the arm cylinder since it accounts for the majority of power output during digging as performed by an expert operator.

When maximizing the power transmitted through the arm cylinder one may not have active control of the trajectory using the arm degree of freedom. The arm on the other hand may have a constant or slowly varying bias input pushing it forward. The speed and force it exerts depends on the sum of internal and load resistance it encounters. Thus, the boom and bucket degrees of freedom may be left for modifying the path followed. Since a digging trajectory would have the arm moving forward, restricting control to exclude the arm actually does not effectively reduce the paths which may be followed as long as the boom and bucket can be coordinated at a sufficiently fast rate. Thus, the task of modifying the path of the digging cycle for the excavator may be expressed as maximizing the power transmitted by the arm by actively controlling the trajectory of the boom and/or bucket joints. The elegance of the implemented method is that even if the throttle on the arm is changed, which would effectively reduce the maximum force capabilities of the machine, the control objective of maximizing the power still remains the same. If everything was linear this would result in the same trajectory, be it moving more slowly. However, due to the nonlinear nature of the system, a different trajectory may maximize the power for actuators with different force capabilities.

Without wishing to be bound by theory, the two degrees of freedom which can be optimized (boom and bucket) by and large serve distinctive purposes during digging. While both can have the effect of changing the resistance seen at the bucket they perform this through different mechanisms. Changing the bucket angle changes the rake angle of the bucket with respect to the soil which may be a significant factor in how much force is encountered when moving through soil. On the other hand, moving the boom primarily changes the height of the bucket with respect to the soil surface. This changes the depth of the soil cut which also has a role in influencing the force between the bucket and soil. During digging though, the bucket also satisfies other operating criteria. In particular, the bucket may be in such a position such that the soil is scooped into it during a final scooping motion which may be strongly influenced by bucket orientation. The boom on the other hand may mainly be used to guide the direction of the bucket trajectory rather than its pose relative to the soil. Thus, for testing of a power maximizing controller it was decided to validate the method initially with only one degree of freedom being optimized in the initial testing. Using the reasoning outlined in the previous paragraph it was decided to use the boom trajectory as the tunable parameter. However, the possibility of optimizing for more than one degree of freedom is also considered.

Example: Excavator Operation

Figure 7A:
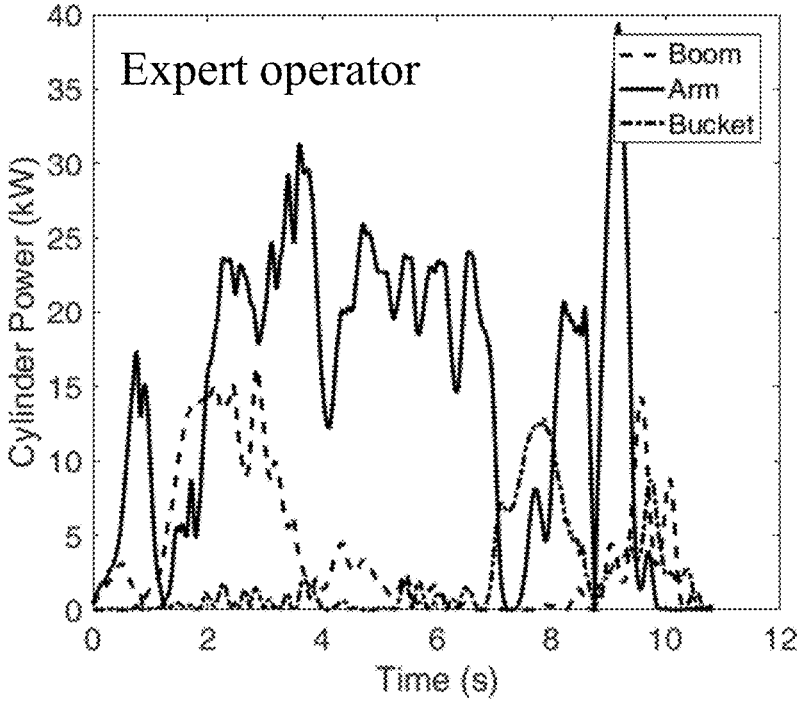
FIG. 7A is a graph of power output for an expert operator.
Figure 8:
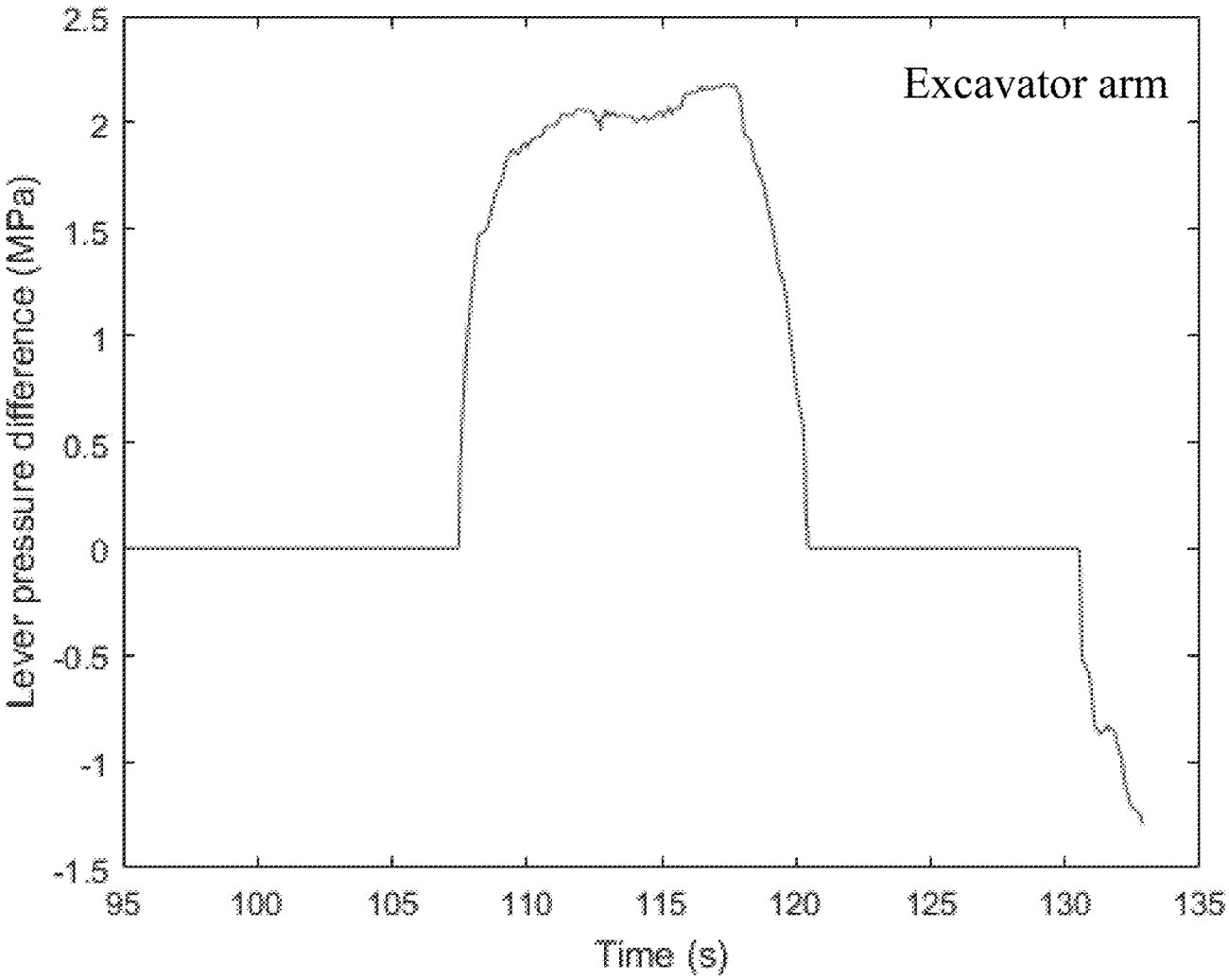
FIG. 8 is a graph of expert operator command input (control valve pressure difference) for an excavator arm.
Figure 9:
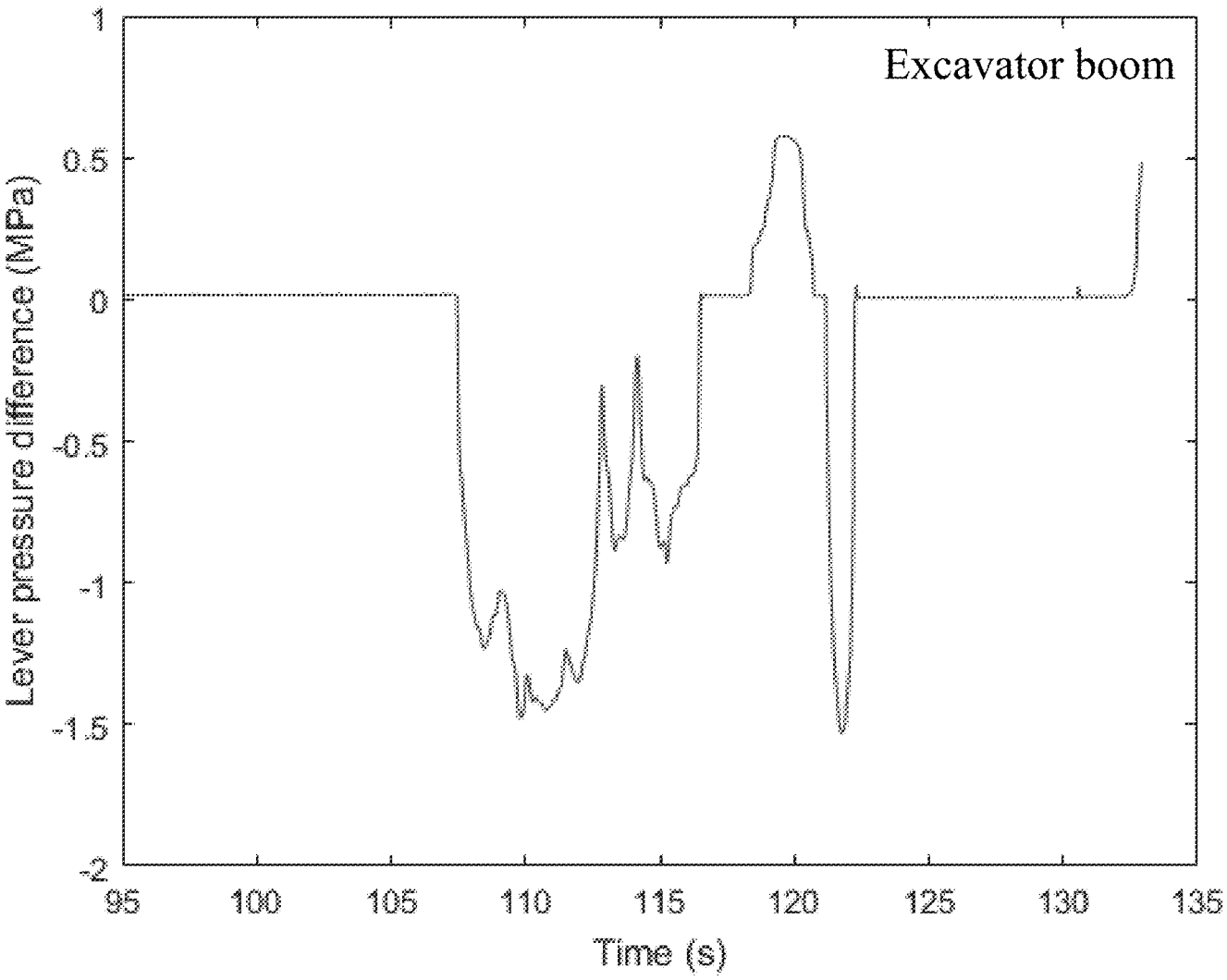
FIG. 9 is a graph of expert operator command input (control valve pressure difference) for an excavator boom.

Machine data was recorded for operation of an excavator as controlled by an expert operator. As seen in FIG. 7A, for the largest portion of the dig cycle the main power output is from the arm hydraulic cylinder. For the middle part of the dig trajectory the arm outputs a lot of power with very little change in command inputs. Specifically, as shown in FIGS. 7A and 8, the arm power increases at the beginning of the cycle but remains largely unchanged for most of the dig cycle. In other words, the arm doesn't appear to be actively controlled. The boom on the other hand varies significantly as the operator adjusts throughout the dig, see FIGS. 7A and 9. Thus, it would appear that, the boom commands were used to modulate the impedance seen by the arm cylinder. On the other hand, during the initial (soil penetration) and final (scooping) portions of the digging cycle, power output is significant from the other actuators too and they are all controlled more actively. That is because during these phases of the digging there are other considerations which take priority over maximizing power output including bucket filling. For example, during the final stage the operator primarily takes into consideration how to ensure that the soil which has been dug and moved during earlier moments of the cycle are effectively scooped into the bucket itself.

Figure 7B:
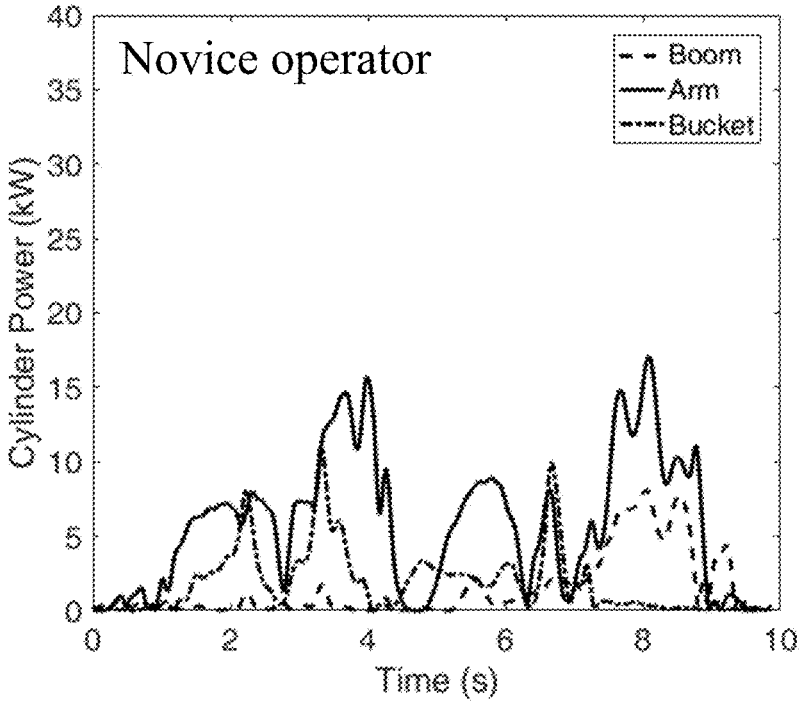
FIG. 7B is a graph of power output for a novice operator.

In contrast to the above, it is interesting to look at the control activity of the various joints during operation by a novice operator. As can be seen from FIG. 7B both the arm and bucket power vary significantly throughout the digging cycle and the boom is only actuated towards the end of the digging cycle. This is in contrast to the above described expert operation of an excavator.

Based on the above, it is hypothesized that the power maximization may be performed primarily during a central part of an excavation cycle (i.e., after initial soil penetration and before the final scooping). Furthermore, during this middle section considering the power output of only the arm as the power metric may appear to be most in line with operating strategies taken by expert operators. However, power optimization of one or more other joints of an excavator are also contemplated as the disclosure is not so limited.

Example: Simulation

Before implementing the algorithm on an experimental system the basis for the algorithm was tested in simulation for a simplified conceptual system. Specifically, a point object with a mass m in a 3-dimensional space with directions $x_1$, $x_2$, and $x_3$ was considered. For the excavator case, each of those directions represents the movement of one joint. This mass also was actuated in each of the three directions. But as outlined previously the controller was assumed to only control two of the three joints ($x_1$,$x_2$) which represent the boom and bucket angles. The remaining degree of freedom, $x_3$, which represents the arm, had a control input which was constant or at the very least slowly varying. Furthermore, the actuation in each degree of freedom was subject to some internal resistance $b_{in}$. Hence the force ($\tau$) exerted on the mass after internal losses was:

$$\tau_i = u_i - b_{in,i} v_i$$

where u is the control effort, v is speed, and the subscript i takes values 1, 2, 3 for each of the three directions. It was assumed that as the mass moves, it is subject to a damping force that varies depending with the location of the mass in the space. Hence the state equations were:

$$\dot{v}_1 = \frac{1}{m}(\tau_i - b_{load,i}(x)v_i)$$

$$\dot{x}_i = v_i$$

where $b_{load,i}(x)$ is the load impedance which is a function of the positions $x_1$, $x_2$, and $x_3$. For this case the transmitted power through the arm was equal to $P_{arm}=b_{load}v_3^2$. In this case the low-level trajectory tracking controller for the directions in $x_1$ and $x_2$ was simply:

$$u_i = k_p(x_{d,i} - x_i) + k_d(v_{d,i} - v_i)$$

where $K_p$ and $K_d$ are the gains for the position and velocity error compensation.

Example: Classic Extremum Seeking

Here the classical extremum seeking method was implemented on the simulated system. Firstly, this was implemented on a system where the impedance varied only with respect to the boom ($x_1$) and does so linearly such that:

$$b_{load,3} = \alpha_0 + \alpha_1 x_3$$

The controller parameters were selected firstly by choosing a perturbation frequency so that the low level controller can follow it with low tracking error. Then a perturbation amplitude was chosen such that at steady state the error caused due to perturbation was tolerably low. From there the filter frequencies were tuned to be separated adequately from the dither frequency and to introduce a minimal phase shift.

Figure 10A:
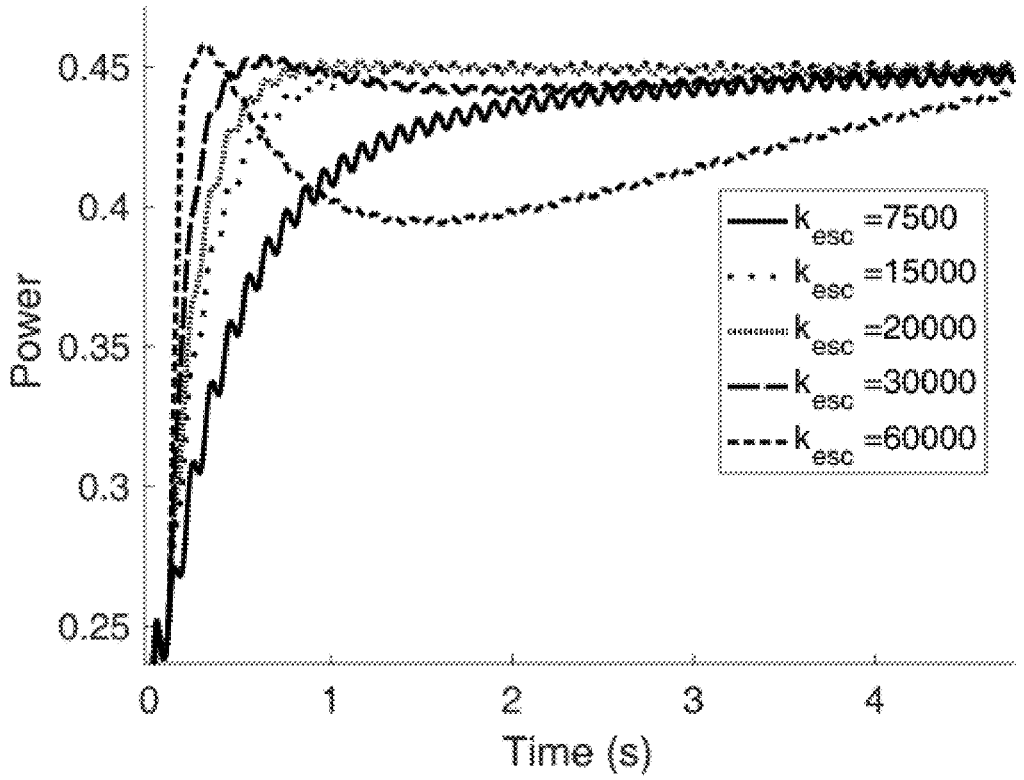
FIG. 10A is a graph of power for sample simulations of power maximizing using classical extremum seeking scheme for varying adaptation gains.
Figure 10B:
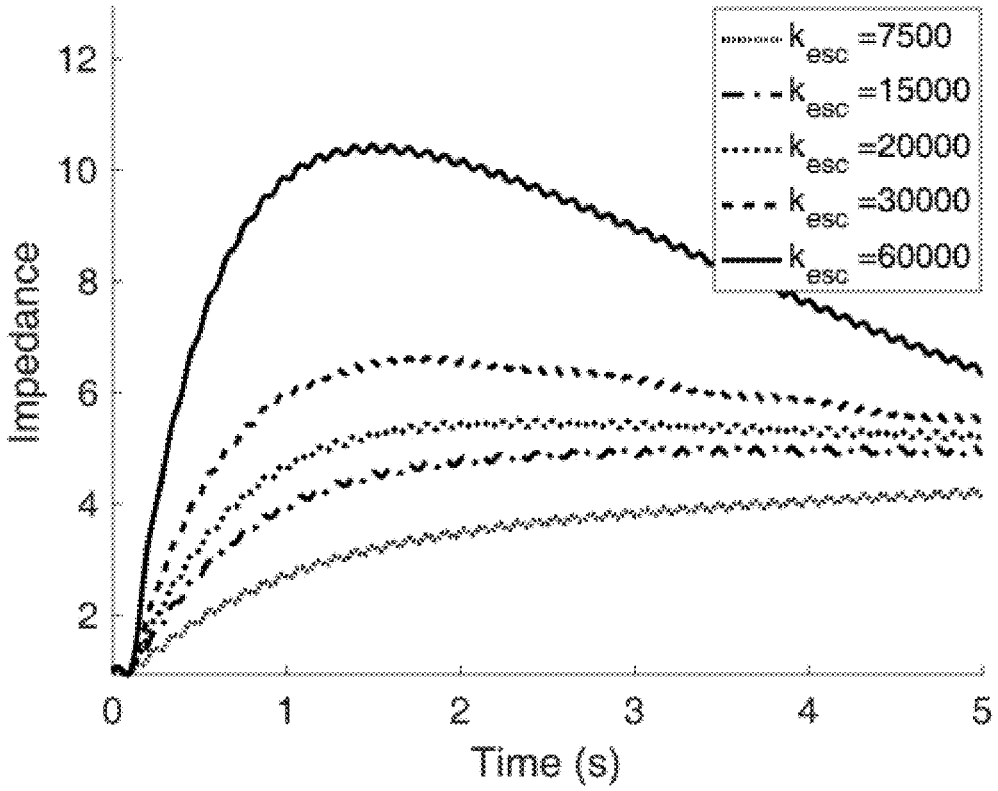
FIG. 10B is a graph of impedance for the simulations of FIG. 10A.
Figure 10C:
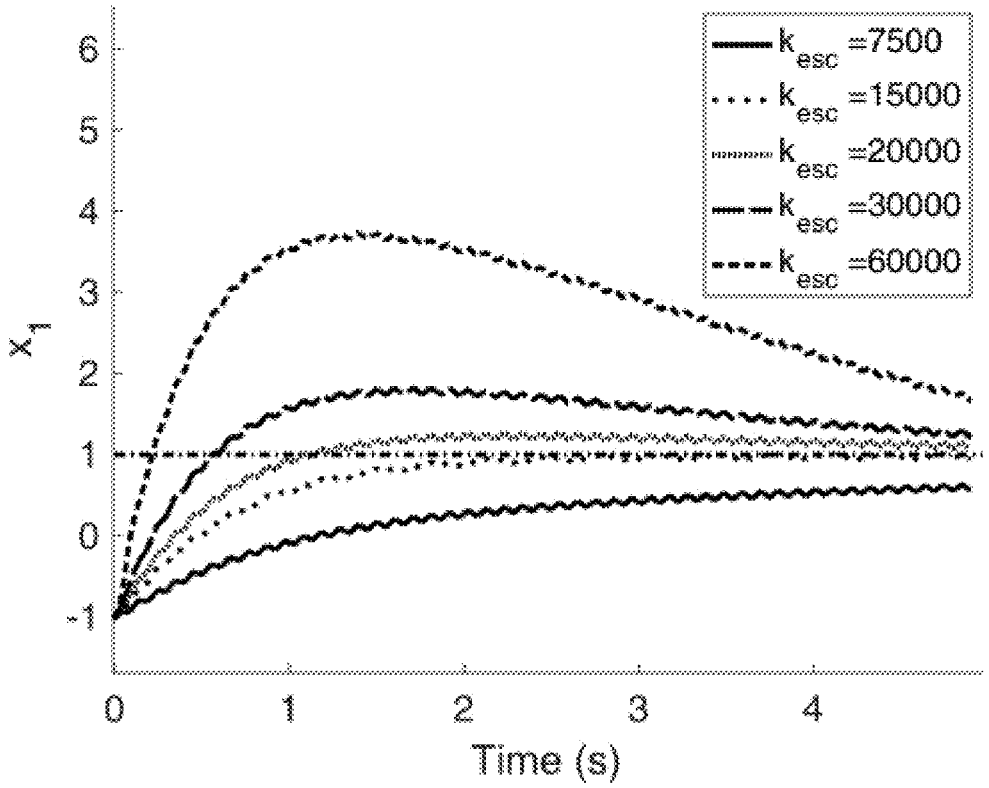
FIG. 10C is a graph of position for the simulations of FIG. 10A.

The adaptation gains were chosen to give the fastest possible convergence rate. The system was simulated for a range of gains. This can be seen in FIGS. 10A-10C. As expected longer convergence times are seen when starting from a low gain, and as the gain is increased the time to converge to the optimal position decreases. However, as one increases the gain further it actually takes longer to reach the optimal point as the substantial overshoot of boom position may cause the impedance to be too high and thus reduces power output as seen in the larger gain values.

Example: Extremum Seeking Using Dither

Figure 11:
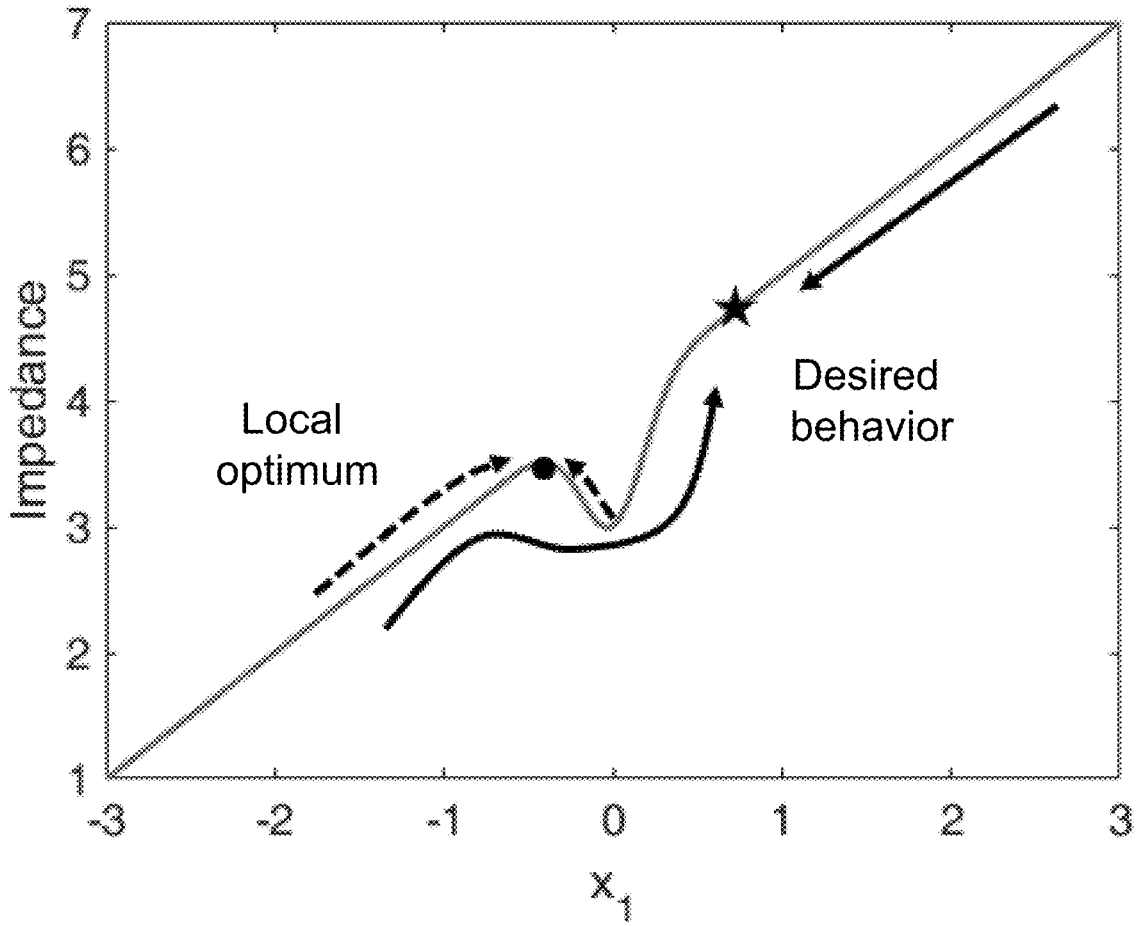
FIG. 11 is an impedance characteristic map with a local extremum point.

Extremum seeking harnesses gradient descent to find optimal parameter values. As such it may be vulnerable to getting 'stuck' in local maximums, see FIG. 11. In this respect the application of a dither (i.e., a time varying input to the commanded nominal path) may be important to explore surrounding parameter values. In this sense the amplitude plays a role in determining the extent to which a controller can surpass local extrema. This is demonstrated through a simulation where the impedance map has a local maximum below the value which would be optimal. As expected with a small perturbation the controller gets stuck at the local maximum but with a larger dither it manages to surpass the intermediate power extremum.

Figure 12A:
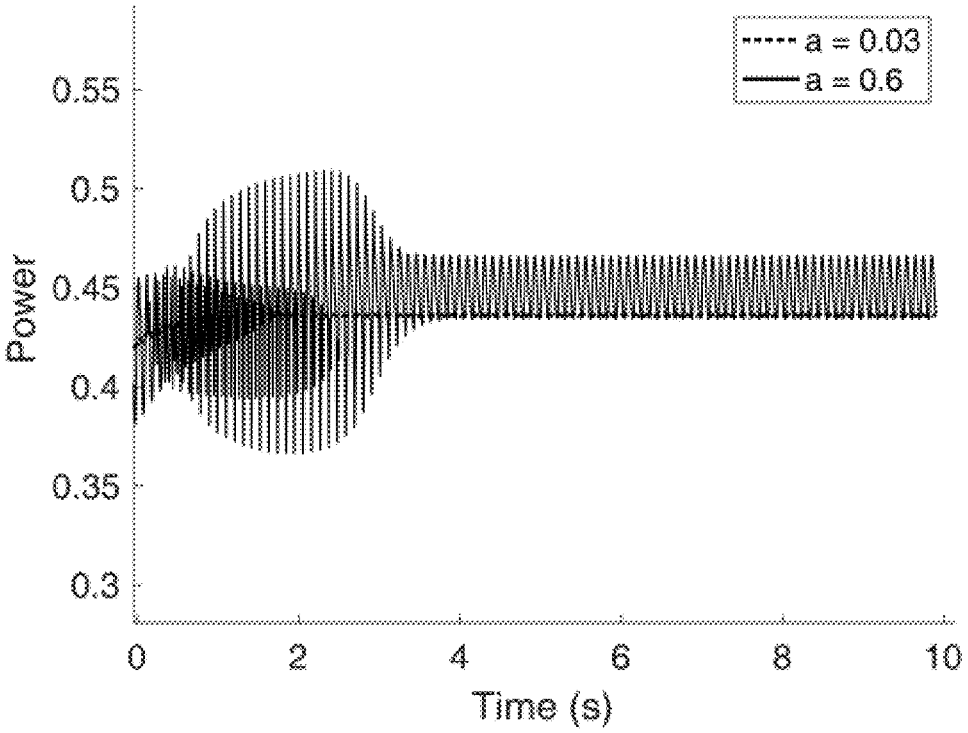
FIG. 12A is a graph of power for a sample simulations using a classical extremum seeking scheme demonstrating the effect of dither amplitude on the ability of the control scheme to surpass local maxima in the performance metric.
Figure 12B:
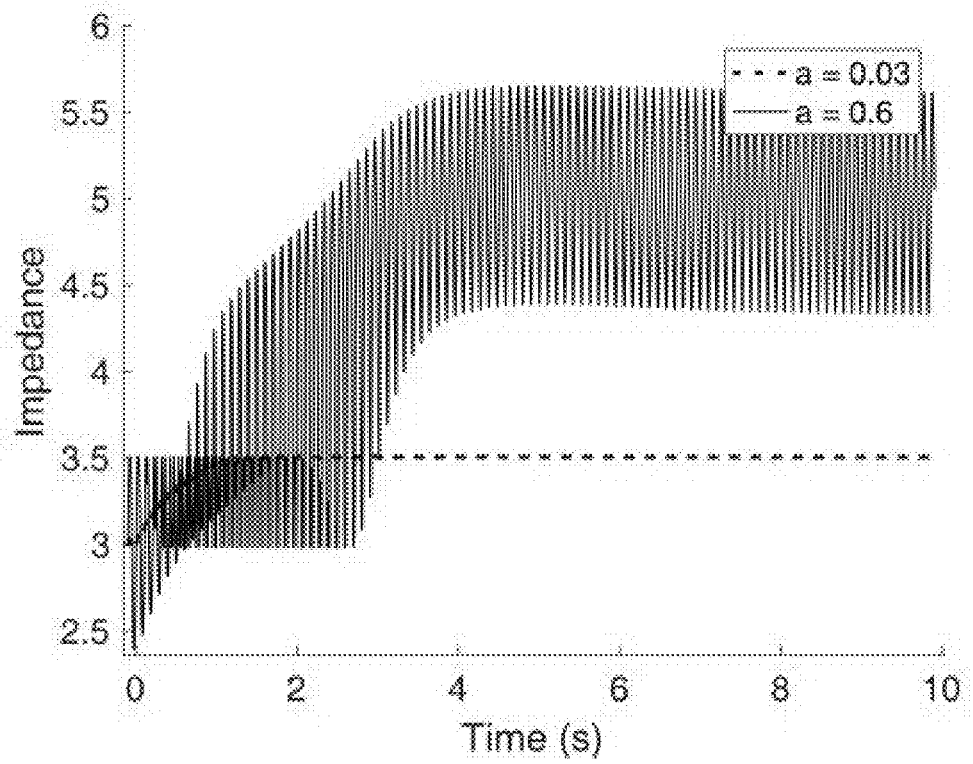
FIG. 12B is a graph of impedance for the simulation of FIG. 12A.
Figure 12C:
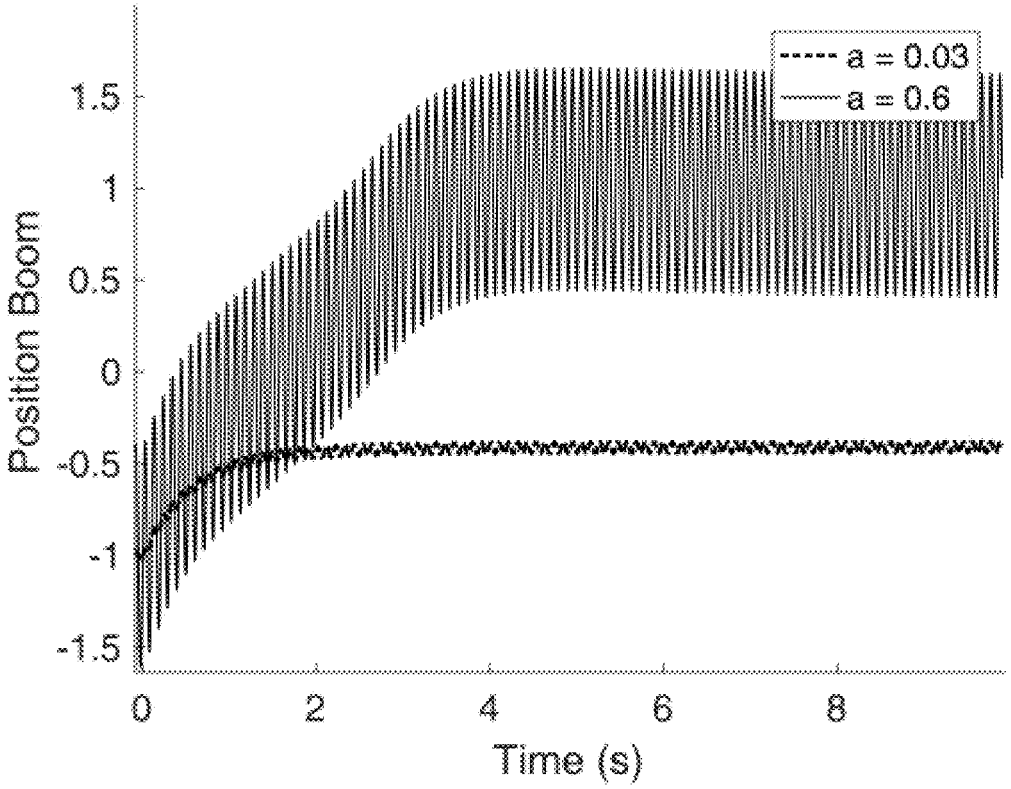
FIG. 12C is a graph of position for the simulation of FIG. 12A.

As can be seen in FIGS. 12A-12C show simulation results for different local extremum landscapes sampled using dithers having magnitudes of 0.03 and 0.6. As expected increasing the amplitude of the dither allows the system to push past the local maximum but at the same time the dither needs to be substantially larger than the expected local extremum. In some instances, this may be considered detrimental to the overall performance of the system. Thus, it may be desirable to balance an overall magnitude of a dither to a commanded path for overcoming local extrema with overall system performance.

In addition to the above, the algorithm including a dither was tested for maximizing power by optimizing for two excavator trajectory parameters, namely the boom and bucket position as well. This was achieved by having two optimizing loops operating on each tunable parameter independently. The condition of having two different dither frequencies for the different degrees of freedom was implemented to enable a controller to separate the different signals using appropriate filters. The simulation settled on a set of optimal solutions.

Example: Dither Free Extremum Seeking

Figure 13A:
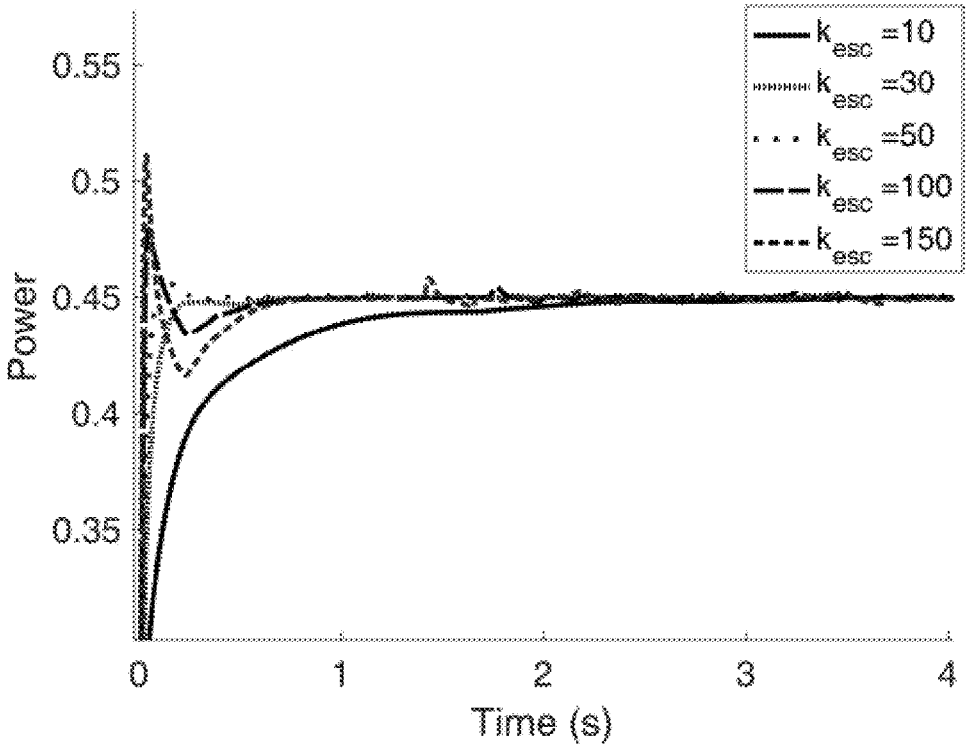
FIG. 13A is a graph of power for sample simulations of power maximizing using a dither-less extremum seeking scheme.
Figure 13B:
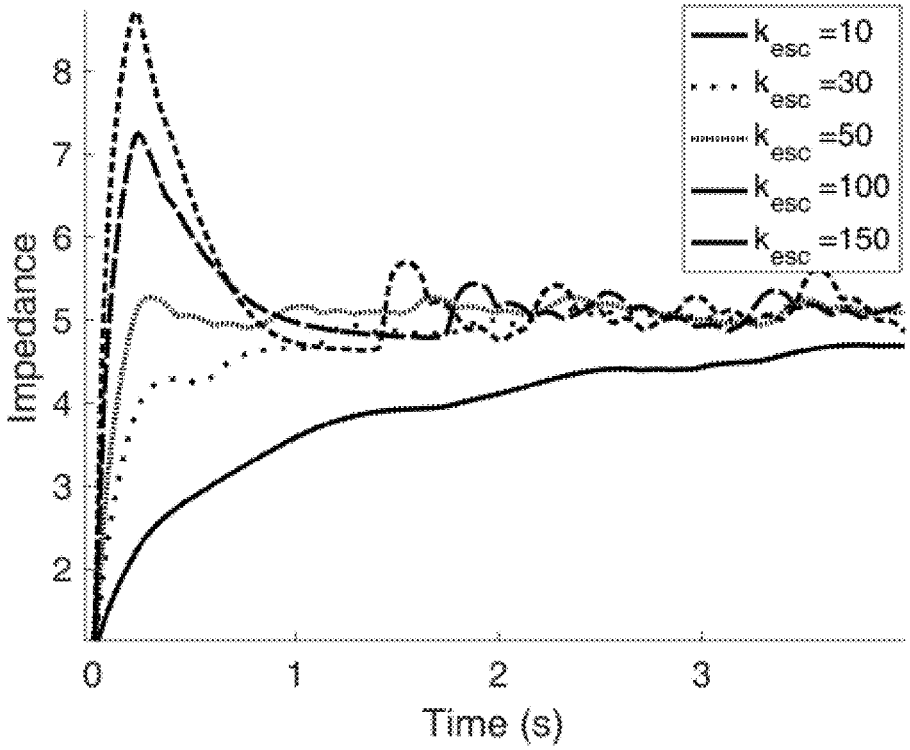
FIG. 13B is a graph of impedance for the simulations of FIG. 13A.

The dither-less extremum seeking algorithm was also implemented. For the same system as described above relative to FIGS. 10A-10C, a dither-less extremum seeking algorithm was applied. As shown in FIGS. 13A and 13B, the dither-less algorithm achieved faster convergence times without overshoot. As the tuned parameter (boom position) reached its optimal value the change in the parameter approached zero. This had the adverse effect of making the gradient estimation incorrect as the estimate converged resulting in distinct irregular oscillation. In some embodiments, such an artifact may be remedied by reintroducing a dither or some other perturbation such as a stochastic sequence of variations applied to a commanded path of the joints being optimized.

Example: Proportional-Integral Extremum Seeking

Figure 14A:
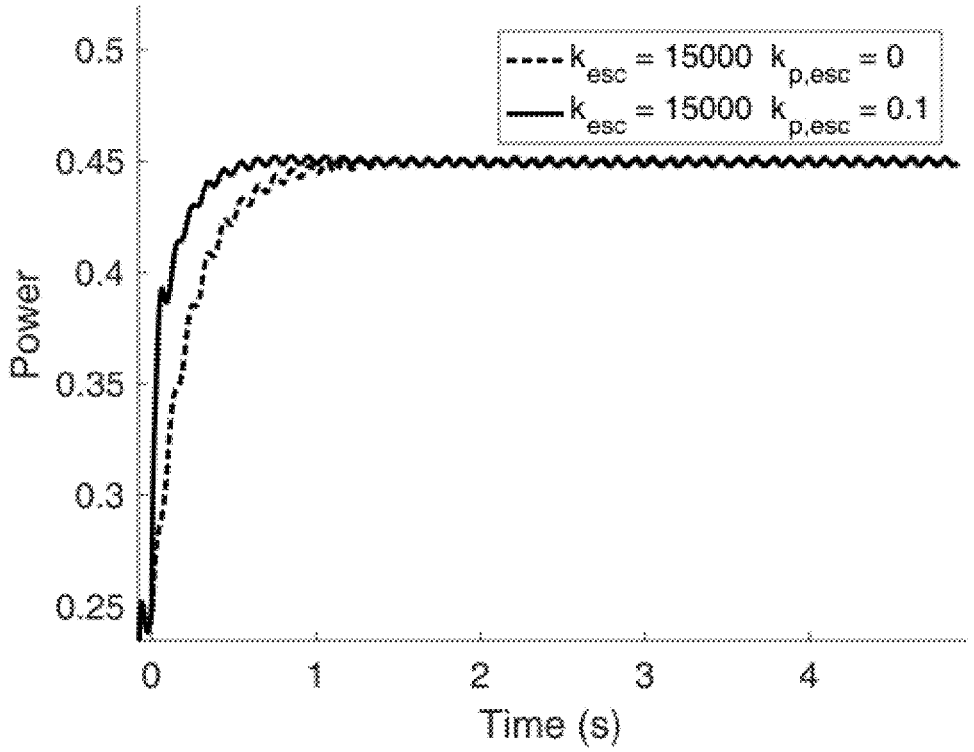
FIG. 14A is a graph of power for sample simulations of power maximizing using classical extremum seeking scheme utilizing Proportional and Integral adaption law.
Figure 14B:
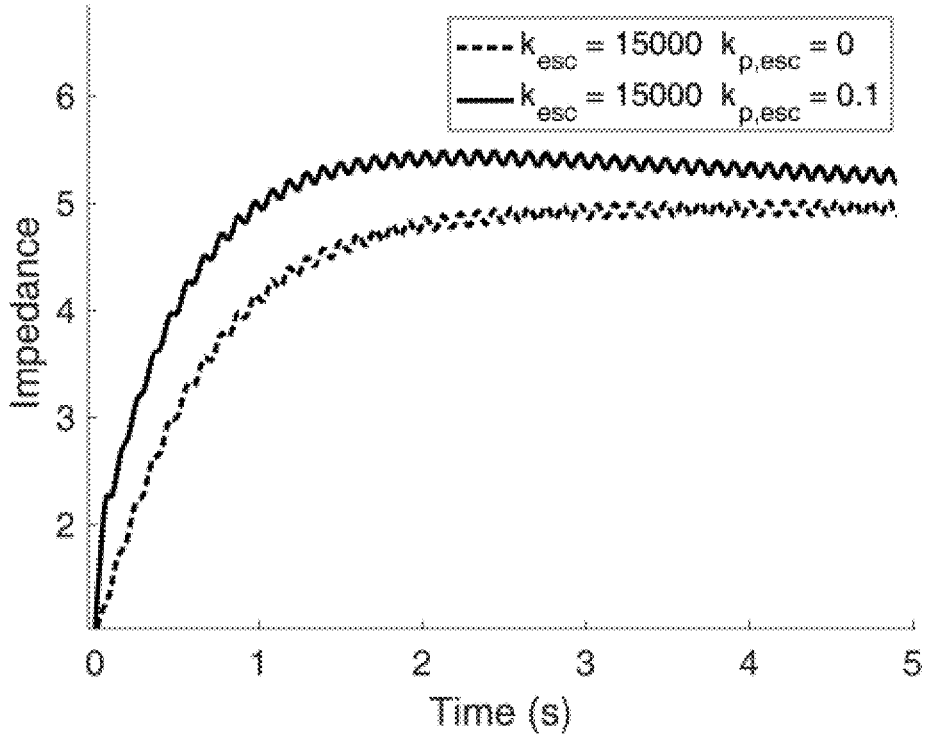
FIG. 14B is a graph of impedance for the simulations of FIG. 14A.

As described above, in some embodiments, it may be possible to achieve a faster transient rate for power maximization by including a proportional term (of the gradient of power with respect to a tunable parameter) to accompany the integral term in the adaptation law. As can be seen from FIGS. 14A and 14B the application of proportional-integral extremum seeking does result in a faster transient.

Example: Recursive Least Squares Algorithm

A simulated system was implemented using a recursive least squares algorithm with a forgetting factor was implemented in a system for maximizing power output. In the applied algorithm, the least squares methodology was used to calculate the estimated local gradient $\tilde{\theta}_1$ of power with respect to boom position. The gradient was determined by estimating the parameters, $\theta_0$ and $\theta_1$, of the simple estimator model:

$$P_m=\theta_1 x_b+\theta_0$$

As such, the gradient estimator is given by:

$$\hat{\theta}(k)=\hat{\theta}(k-1)+\frac{\sum_{k-1}\xi(k)\left[P_m(k)-\xi^T(k)\hat{\theta}(k-1)\right]}{\alpha+\xi^T(k)\Sigma_{k-1}\xi(k)}$$

$$\Sigma_k=\frac{1}{\alpha}\left[\sum_{k-1}-\frac{\sum_{k-1}\xi(k)\xi^T(k)\Sigma_{k-1}}{\alpha+\xi^T(k)\sum_{k-1}\xi(k)}\right]$$

where k is the time step, $\tilde{\theta}(k)=[\tilde{\theta}_1(k)]^\tau\in\mathbb{R}^{2\times1}$ is the estimated parameter vector at time k with $\tilde{\theta}_1(k)$ being the local gradient as defined previously and $\tilde{\theta}_0(k)$ is the offset. $P_m(k)\in\mathbb{R}$ is the arm power measurement at time k and $\xi(k)=(k)[x_b(k)\ 1]^T\in\mathbb{R}^{2\times1}$ is the regressor which is composed of the boom position and a constant unity term. $\tau_k\in\mathbb{R}^{2\times2}$ is the covariance matrix used for the parameter estimation at time k and $\alpha$ is the 'forgetting factor' which is set between 0 and 1.

The estimated gradient was then padded by zeros to make a new vector $\psi$, whose dimensions were consistent with the input to the low level controller $u(k)=[x_{1,d}\ x_{2,d}\ x_{3,d}]^T\in\mathbb{R}^{3\times1}$. The variables are the desired actuator positions for the low level controller where i=1, 2, 3 represented the desired position trajectory for the boom, arm, and bucket, respectively.

$$\psi(k)=[\tilde{\theta}_1(k)0\ 0]^T\in\mathbb{R}^{3\times1}$$

The input u(k) in discrete time were then determined using the adaptation law:

$$u(k)=K_p\psi(k)+\gamma(k)+d(k)+r(k)$$

$$\gamma(k)=\frac{1}{2\tau_I}[\psi(k)+\psi(k-1)]+\gamma(k-1)$$

where $K_p\in\mathbb{R}$ is the proportional ESC gain and $\tau_1\in\mathbb{R}$ is the ESC integration time constant. d(k) is the dither used to excite the system to be able to detect the local gradient. A sinusoidal dither was used which is equivalent to:

$$d(k)=[b_1\sin(\omega_1 k/\Delta t)0\ 0]^T\in\mathbb{R}^{3\times1}$$

where $\omega_1\in\mathbb{R}$ is the dither frequency, $b_1\in\mathbb{R}$ is the dither amplitude and $\Delta t\in\mathbb{R}$ is the sample time. $r(k)\in\mathbb{R}^{3\times1}$ is the reference trajectory determined from a trajectory planner which can be paired with the proposed algorithm.

Example: Experimental Validation

After doing preliminary tests on the simulated system, the algorithm was validated using a small-scale excavation rig which was designed and built to test the algorithm. Specifically, the applied method utilizing extremum seeking control aimed to maximize the power output from the arm joint of an excavator as a means of devising advantageous trajectories. As detailed further below in the experimental results, power maximizing allowed the impedance characteristic of the machine and soil load to be well matched, thus ensuring that the movement of the bucket through the soil was balanced between the extremes of getting stuck due to too high resistance and interacting with the soil too weakly resulting in little work being done on the site. The experimental work done on a small-scale excavation rig demonstrated the effectiveness of the strategy and suggested its promise in application to more realistic excavation systems.

The design and manufacture process for the laboratory excavator rig included various considerations. For example, in addition to being designed to fit within the allocated workspace, the joints and various linkages were designed with several desired functionalities. This included: providing low level control actuation to 3 rotational degrees of freedom; actuators being able to support the forces from weight and digging; as well as providing the ability to measure force at the bucket and capture video streams of the soil around the bucket.

To satisfy the above, the forces for digging through soil were determined. This was done by attaching a 6-axis force sensor to a bucket (manufactured through 3-D printing). The bucket was then attached to a rudimentary arm constructed from aluminum extrusion. This passive arm was then moved through the soil in a digging motion by hand. The measured force was used to evaluate an estimate for the forces which would be encountered during excavation. The magnitude of force never exceeded approximately 50 N.

To reduce the amount of self-weight loading from heavy motors and gearing the motor for the arm was implemented via a 4-bar linkage mechanism. The length ratios of the linkages (boom, arm and bucket) was determined from the proportions of typical excavators. Then to determine the length of the linkages the largest feasible size (for the space and available motors) was determined with a safety factor of 2 on the force needed to bear the force. Furthermore, the linkage cross sections were determined such that deflections from the force at the bucket would total to less than 5 mm under the digging force load.

For manufacturing, the linkages were cut using water-jet machining. The linkage joints used a pair of flanged deep groove ball bearings preloaded into a back-to-back configuration for high stiffness. The bores for mounting the bearing were drilled and reamed on a mill and machined to a tolerance which allowed for a transition fit of the bearings outer race. Shoulder bolts preloaded with spring washers were used as the inner race shaft.

The actuators for the robot were 90 W low-profile ("Pancake") motors with 50:1 Harmonic Drive Gearing for the boom and arm motion and a 100 W Dynamixel Pro Servo for the bucket. The Maxon motors utilized Maxon ESCON 50/5 motor drivers while the Dynamixel had incorporated drivers. Low level control was handled by a micro-controller which communicated directly with the drivers. For this implementation an Arduino Mega was used. This in turn communicated via serial communication with a PC running ROS (Robot Operating Software). ROS handled tasks such as computer vision, managing sensors such as IMUs and force sensors and also the communication between inputs such as joysticks (for manual control).

The simulated machine dynamics were implemented through using a velocity feed-back law which dictated the current based on actuator speed. This relied on the assumption that the force exerted by the actuator was proportional to the current through the rotor. Without wishing to be bound by theory, as long as the electrical dynamics are substantially faster than the speed mechanical dynamics then this assumption is valid. Furthermore, there were losses due to the gearing. This means that in effect there was less force exerted on the environment than calculated based on the current. The feedback law is:

$$i_d = i_{bias} - R_{int}\omega$$

where $i_d$ is the desired current sent to the ESCON driver which implemented a high bandwidth current controller, $i_{bias}$ is the current at stall, $R_{int}$ is the internal simulated resistance and dictated the gradient of force with respect to velocity and finally, $\omega$ is the speed of the motor. By measuring the current and speed of the motor it was confirmed that the controller effectively managed to implement the desired relation between current and speed.

Example: Power Maximizing Algorithm

As explained above, it is possible to perform extremum seeking for multiple parameters. For excavation this would translate to being able to optimize the trajectory simultaneously for the movement of the boom and bucket, and/or any other desired linkage, when optimizing for the power of the arm. As explained previously, for an excavator it may be desirable to focus on the boom for impedance matching purposes in some applications.

Here details specific to how the algorithm was implemented are presented. Preliminary trials were run where only the local gradient estimation was implemented while following some predetermined trajectories. The first thing that became obvious was that it was difficult to maintain a faithfully executed dither. The propensity for the bucket to get stuck prevented the dither form being well executed in these experiments. As such it was difficult to obtain the local gradient with the classical dither correlation method though application of a dither on other systems is still contemplated. Instead, using the dither-less method described above, the boom was simply moved in some direction within a desired buffer time. Thus, the dither-less method was used but a small dither was inserted anyways to ensure that the boom was moving.

Numerically the adaptation law implemented during testing used the discrete time equation:

$$x_{1,\hat{\theta}}(t) = x_{1,\hat{\theta}}(t-1) + k_I T_s\left(\frac{\theta(t)+\theta(t-1)}{2}\right) + k_p\theta(t)$$

where $k_1$ and $k_p$ are the integral and proportional gains of the adaptation law for the boom. The proportional term may be set to zero depending on if the proportional gain is deemed beneficial and appropriate based on experimentation.

To validate the algorithm on the small-scale excavation rig an experiment was designed which could evaluate the effectiveness of the algorithm. The experiment was devised such that the excavator was brought to an initial position using speed control for each joint. Then when it reached the set position the power maximizing mode was activated. Then the excavator followed its commanded path with the arm motion being dictated by the load resistance. When it reached the end of the arm stroke the power maximizing mode was switched back to speed control mode and the excavator was brought to a stop. Then the terrain was reset by hand and subsequent tests were then implemented. To keep conditions between trials constant the soil was mixed and smoothed out after each trial. This was done to try and minimize variability between trials.

To evaluate the effectiveness of the algorithm the performance was evaluated with and without any adaptation. The adaptation was deactivated by setting both $k_1$ and $k_p$ to zero. The nominal trajectory of the boom was a constant boom joint velocity. As with the simulation the various aspects were investigated experimentally.

Figure 15A:
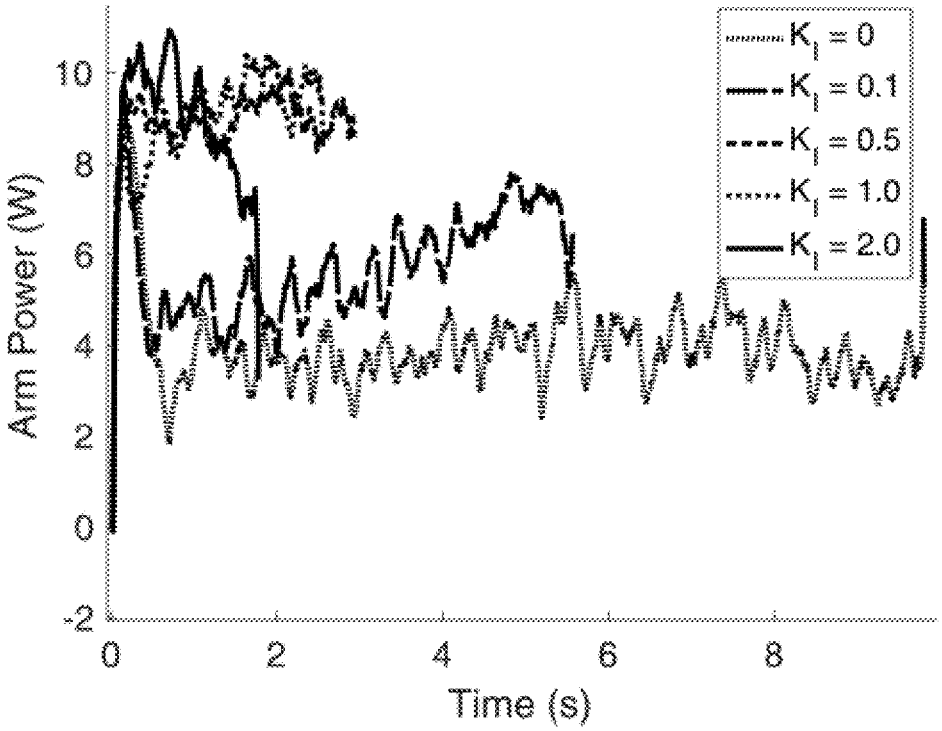
FIG. 15A is a graph of arm power for an experimental excavator implementing power maximizing extremum seeking with different gains.
Figure 15B:
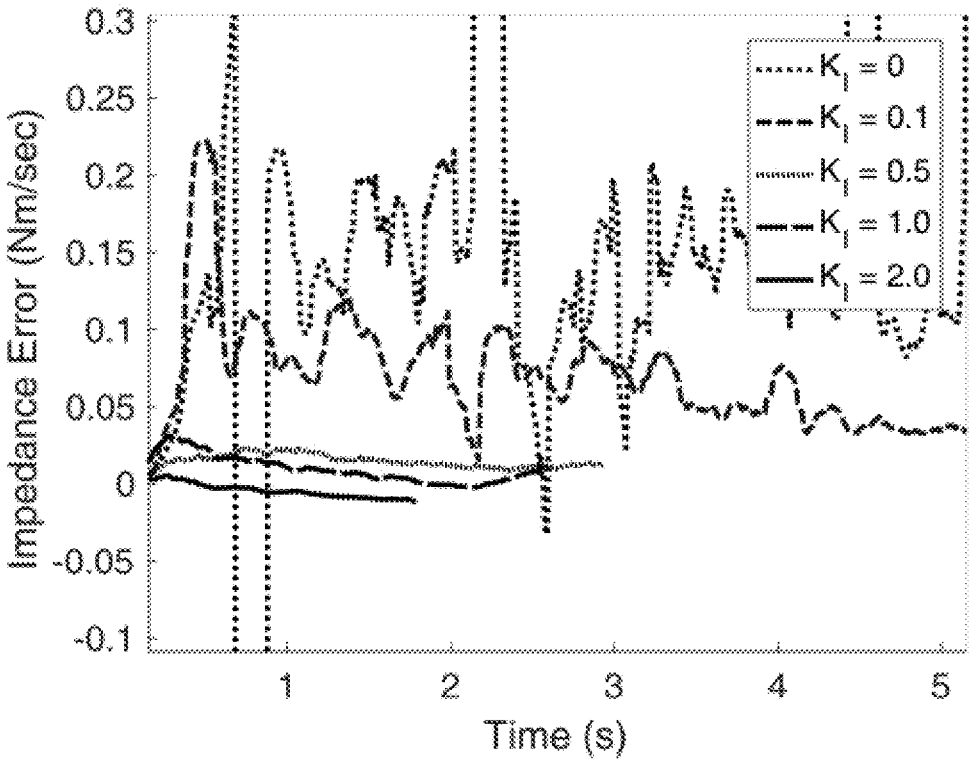
FIG. 15B is a graph of impedance error for the experiments of FIG. 15A.
Figure 15C:
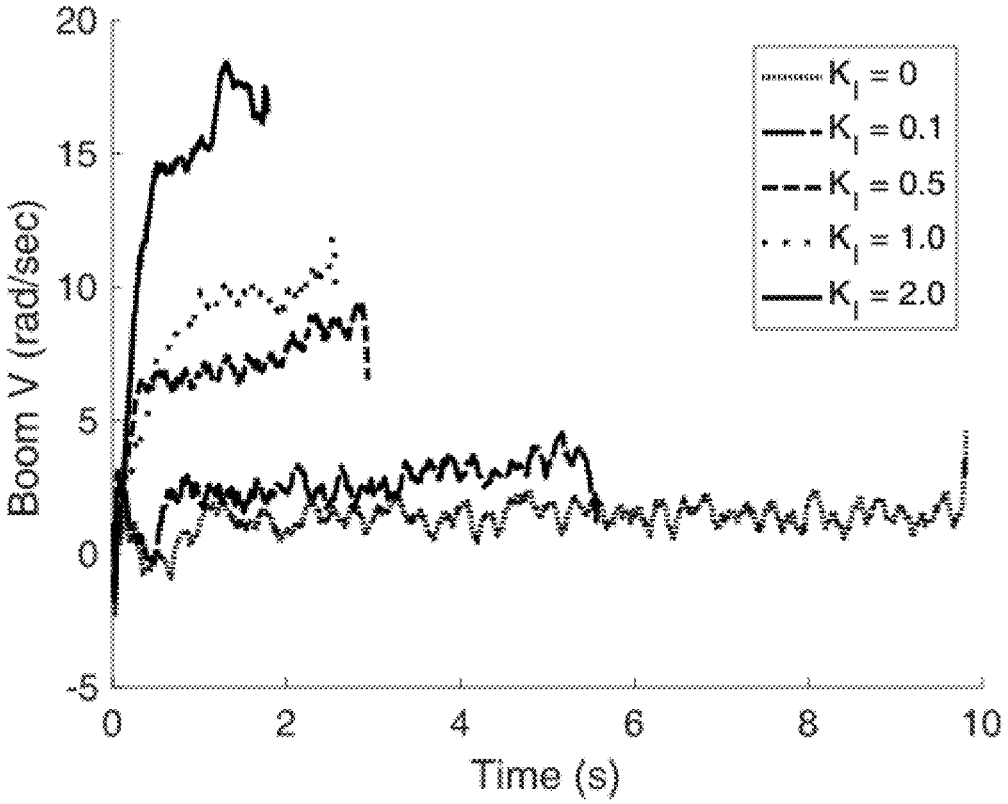
FIG. 15C is a graph of boom velocity for the experiments of FIG. 15A.

The first observation during testing was a qualitative examination of the algorithm. This can be seen clearly in the motion of the bucket which without the power maximizing algorithm frequently became stuck in the soil. When the power maximizing algorithm was implemented, the bucket traced a path which was visibly smoother but still quite submerged in the soil. Furthermore, this was confirmed quantitatively by looking at the power and impedance data from the machine. As can be seen from FIGS. 15A-15C, the introduction of adaptation gain increased the power transmitted to the environment. As one increases the gain, the rate at which the boom velocity changed also increased. This lead the excavator to be in a state where it transmitted close to the maximum power more quickly. Just as with the simulation, when the adaptation gain was too high, the boom velocity overshot and the impedance became too low which also had the negative effect of decreasing the power output.

Example: Proportional-Integral Adaptation Power Maximizing

Figure 16A:
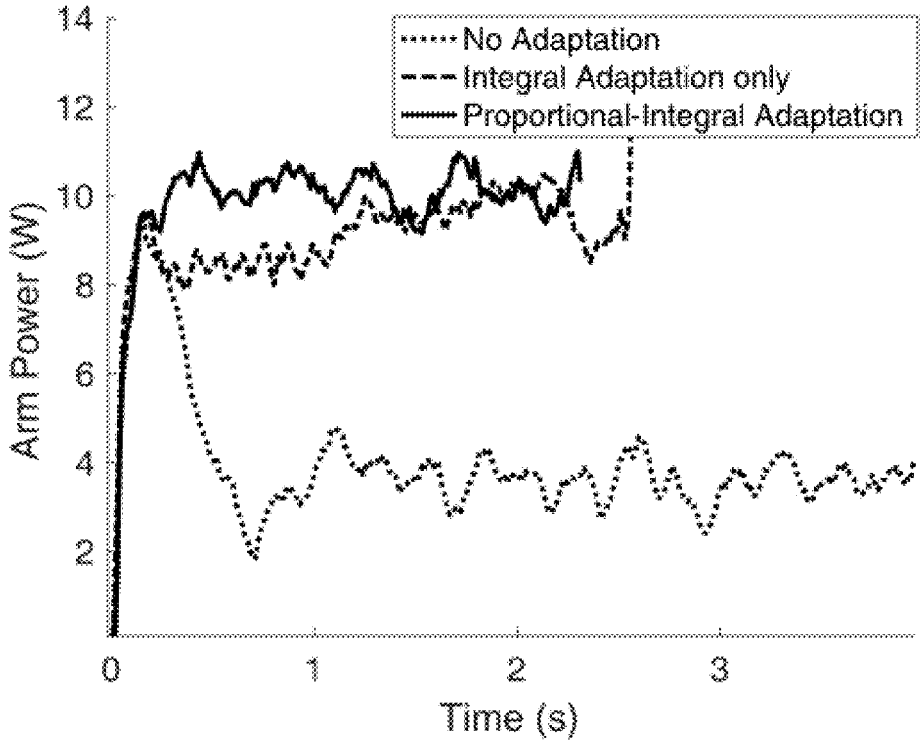
FIG. 16A is a graph of arm power for an experimental excavator implementing different power maximizing extremum seeking strategies including no adaptation, integral adaptation only, and proportional-integral adaptation.
Figure 16B:
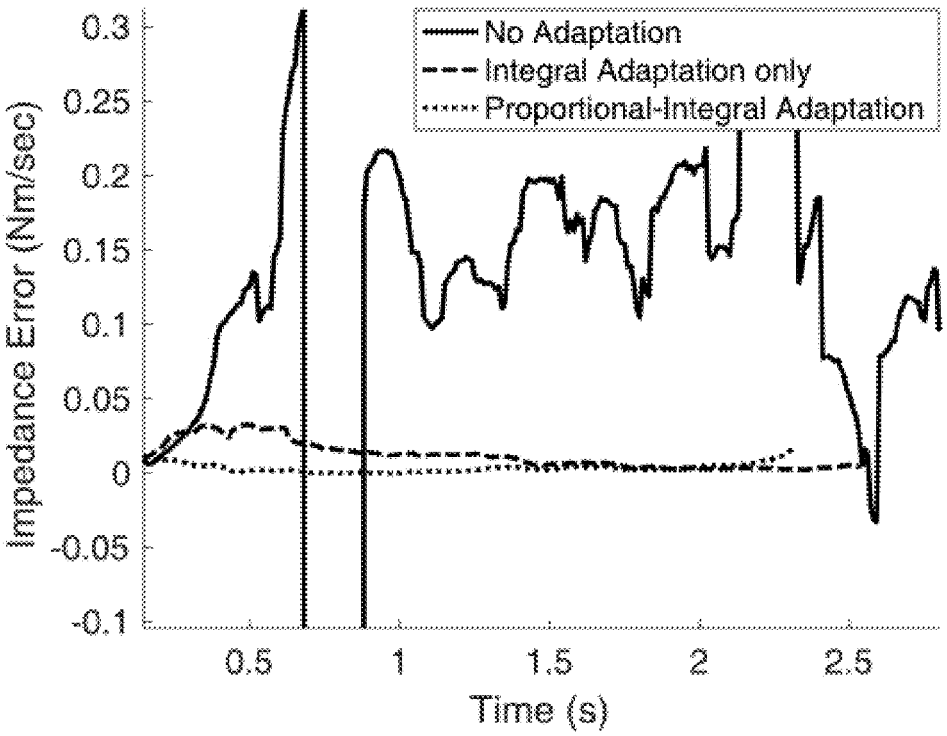
FIG. 16B is a graph of impedance error for the experiments of FIG. 16A.
Figure 16C:
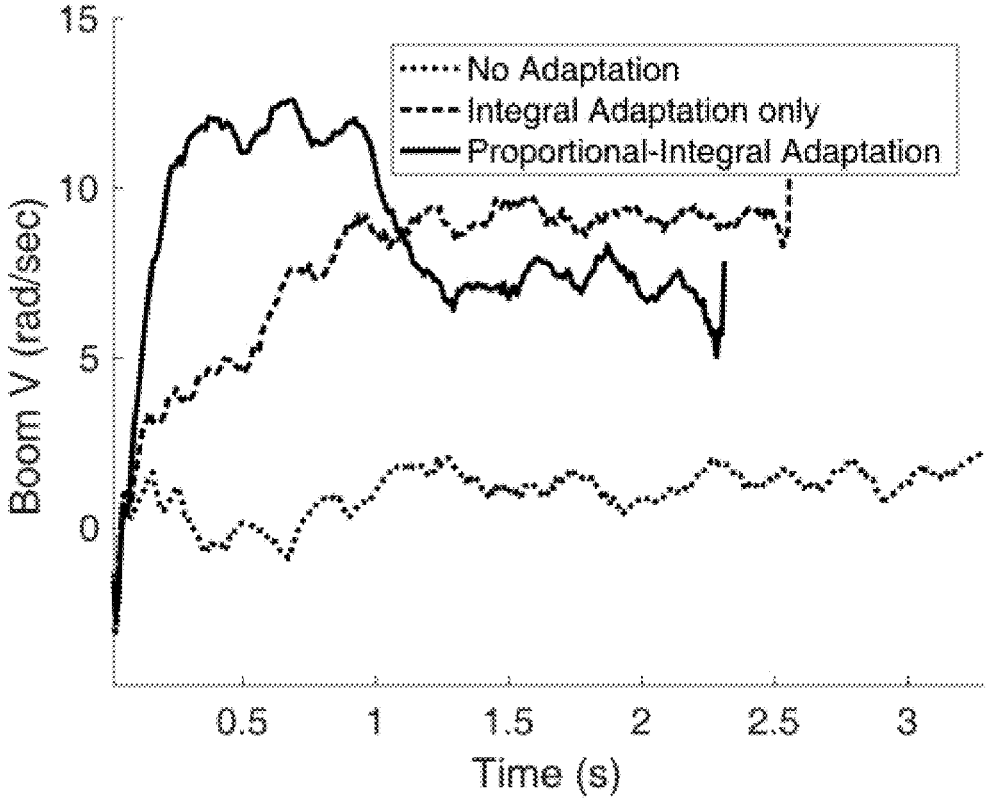
FIG. 16C is a graph of boom velocity for the experiments of FIG. 16A.

In simulation it was suggested that including a proportional term in the adaptation law could help improve the transient response for adapting the boom trajectory. This was tested in experiment by simply replicating the same experiments as described above but including proportional adaptation too as described previously. The integral gain was kept constant between trials. As can be seen from FIGS. 16A-16C the transient performance was notably improved. Looking at FIG. 16C, for the integral only adaptation the boom velocity ramped up within the first second before flattening out. With proportional adaptation though, the boom velocity reached a high value much more quickly.

Example: Soil Property Transition

One challenge in excavation is that an autonomous excavator may need to deal with different soil properties and select appropriate trajectories during either different and/or during a single digging cycle. These different scenarios are detailed below.

Figure 17A:
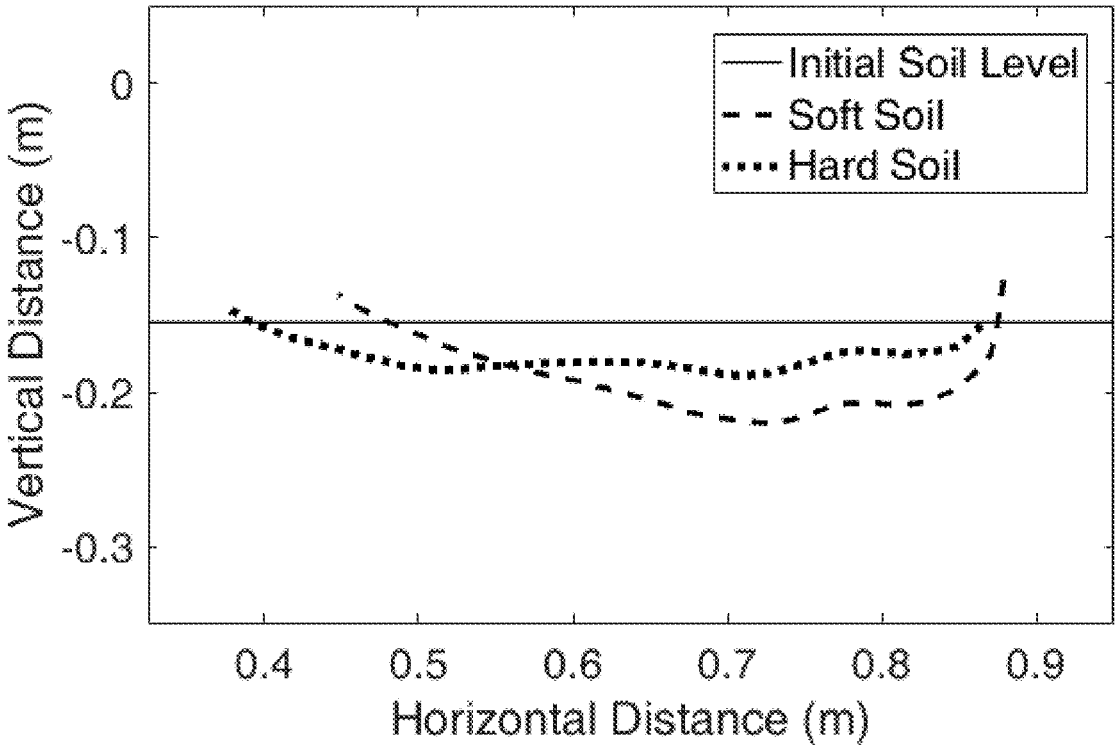
FIG. 17A is a graph of vertical distance for an experimental excavator operating through different soil conditions.

The small scale excavation rig described above was tested on a soft soil, which was a dry sand, as well as a hard soil, which was a wet and compacted sand. A series of single dig cycles in each of the two environments were performed. Averages of these cycles are plotted in FIG. 17A. As would be expected, the algorithm adapted to the differences in the environments, resulting in distinctly different digging trajectories each in each media while the excavator operated near the maximum power state. As seen in FIG. 17A, the hard soil trajectories resemble the typical shallow 'penetrate-drag-scoop' pattern while the softer soil trajectories took a deeper and shorter path. These findings match the preferred method used by experts in loose soil. The soft soil trajectories, in fact, were on average about 70% deeper compared to the hard soil.

Figure 17B:
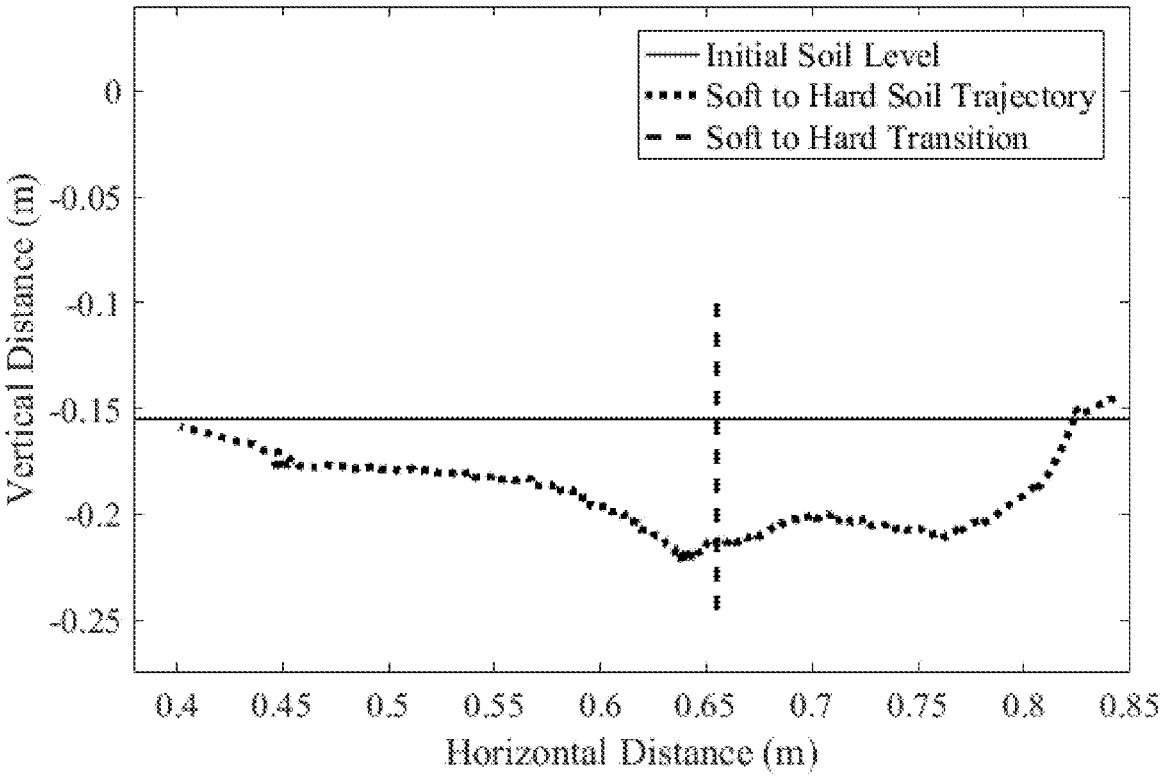
FIG. 17B is a graph of vertical distance for an experimental excavator operating through soil hardness transitions.
Figure 17C:
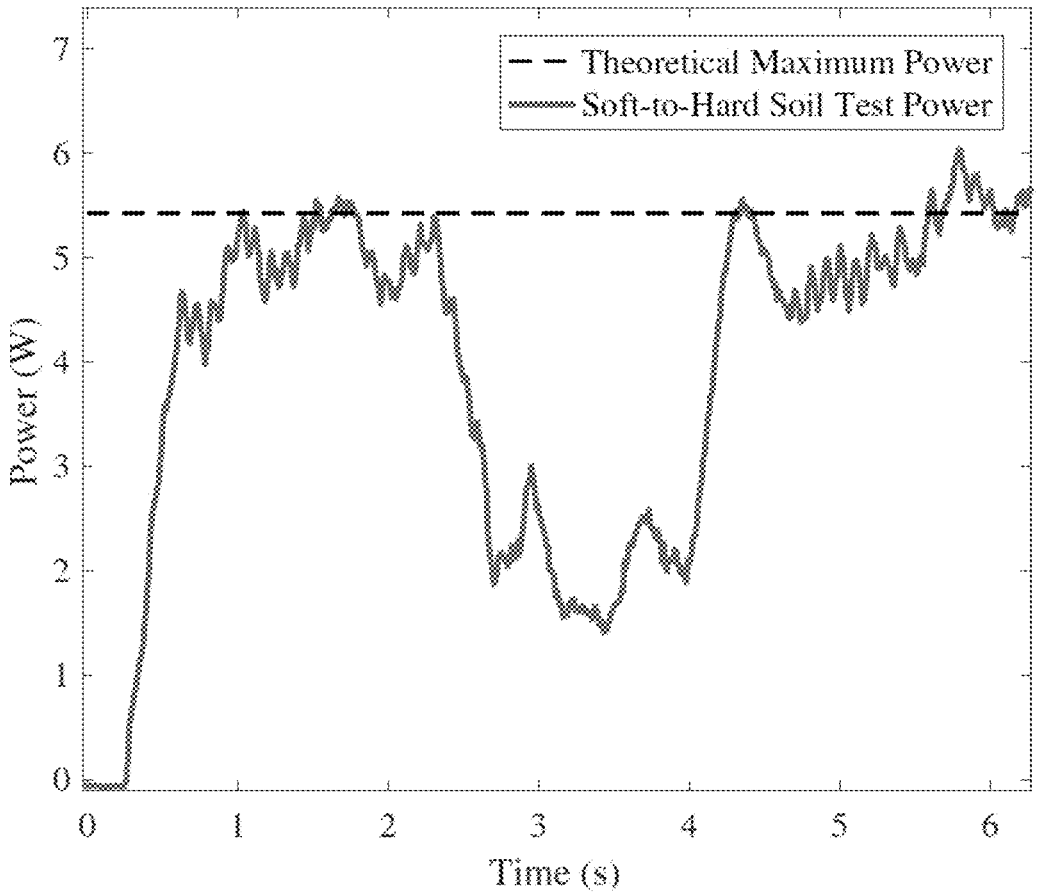
FIG. 17C is a graph of power for the experiments of FIG. 17B.

As noted above, soil properties are highly variable and can differ greatly throughout even a single excavation cycle. To replicate this phenomenon, a soil environment was established where there was a step change in soil hardness at a given point in the horizontal direction. This step change was achieved by setting up the soil with a divider which was used during filling of the soil container. Soft soil was deposited in one region on one side of the divider, while hard soil was deposited in another region on the other side of the divider. This divider was then then removed prior to testing. Tests were performed for both hard-to-soft and soft-to-hard soil transitions. One such testing result using the described small scale excavator for a digging cycle going through a soft-to-hard transition tests can be seen in FIG. 17B. As shown in the figure, for soft-to-hard transitions, the penetration and initial drag is at a deep depth within the softer soil and the trajectory quickly moves to a shallow depth once the hard soil region is reached. The converse occurs for the hard-to-soft soil transitions. Furthermore, FIG. 17C shows how, after encountering the new soil type, the power momentarily dips. After an adjustment in cutting depth, a maximum power state is promptly restored within the new soil properties.

The above-described embodiments of the technology described herein can be implemented in any of numerous ways. For example, the embodiments, including the methods described herein, may be implemented using hardware, software or a combination thereof. When implemented in software, the software code can be executed on any suitable processor or collection of processors, whether provided in controller as a single computing device or distributed among multiple computing devices. For example, a processor may be configured to execute the disclosed methods. In one such embodiment, the methods may be executed by a processor using processor executable instructions stored in at least one associated non-transitory computer-readable storage medium that may perform the disclosed methods when executed by at least one processor. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Further, it should be appreciated that a computing device, computer, or controller may be embodied in any of a number of forms, such as a rack-mounted computer, a desktop computer, a laptop computer, a tablet computer, integrated circuitry, and/or any other appropriate computing device. Additionally, a computer may be embedded in a device not generally regarded as a computer but with suitable processing capabilities, including a Personal Digital Assistant (PDA), a smart phone or any other suitable portable or fixed electronic device.

Also, a computing device or controller may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computing devices and/or controllers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present disclosure as discussed above. Additionally, it should be appreciated that according to one aspect of this embodiment, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A method of operating an excavator during a digging cycle, the method comprising:

commanding a nominal path of a bucket through an environment, wherein the bucket is connected to one or more linkages of the excavator; and applying a correction to the commanded nominal path to increase a power applied by at least one of the one or more linkages to the environment during at least a portion of the digging cycle.

2. The method of claim 1, wherein applying the correction to the commanded nominal path to increase the power includes maximizing the power applied by the at least one of the one or more linkages during the at least a portion of the digging cycle.

3. The method of claim 1, further comprising determining a gradient of power with velocity of the at least one of the one or more linkages.

4. The method of claim 3, further comprising controlling a velocity of the at least one of the one or more linkages based at least partly on the determined gradient to increase the power applied by the at least one of the one or more linkages.

5. The method of claim 1, wherein the at least one of the one or more linkages is an arm of the excavator.

6. The method of claim 1, further comprising varying a velocity of the at least one of the one or more linkages to determine a gradient of power with velocity.

7. The method of claim 1, further comprising sensing variations in the applied power and velocity of the at least one of the one or more linkages from a commanded path of the bucket to determine a gradient of power with velocity.

8. The method of claim 7, wherein sensing variations in the applied power and velocity includes sensing variations in the applied power and velocity with at least one selected from the group of force transducers, current sensors, accelerometers, encoders, pressure transducers, and flow sensors.

9. The method of claim 7, wherein sensing variations in the applied power and velocity and applying the correction to the commanded nominal path are performed continuously during the at least a portion of the digging cycle.

10. The method of claim 1, wherein when the commanded nominal path of the bucket passes through a first region of the environment with a first soil property a first correction is applied to the commanded nominal path to maximize the power in the first region, and wherein when the commanded nominal path of the bucket passes through a second region of the environment with a second soil property different from the first soil property, a second correction is applied to the commanded nominal path to maximize the power in the second region.

11. An excavator comprising:

a bucket;

one or more linkages operatively coupled to the bucket, wherein the one or more linkages include one or more associated actuators;

one or more sensors configured to detect one or more operating parameters of the one or more linkages during a digging cycle;

a processor operatively coupled to the one or more actuators and the one or more sensors, wherein the processor is configured to command a nominal path of the bucket through an environment during a digging cycle and apply a correction to the commanded nominal path to increase a power applied by at least one of the one or more linkages to the environment during at least a portion of the digging cycle.

12. The excavator of claim 11, wherein the processor is configured to apply the correction to the commanded nominal path to maximize the power applied by the at least one of the one or more linkages during the at least a portion of the digging cycle.

13. The excavator of claim 11, wherein the processor is configured to determine a gradient of power with velocity of the at least one of the one or more linkages.

14. The excavator of claim 13, wherein the processor is configured to control a velocity of the at least one of the one or more linkages based at least partly on the determined gradient to increase the power applied by the at least one of the one or more linkages.

15. The excavator of claim 11, wherein the at least one of the one or more linkages is an arm of the excavator.

16. The excavator of claim 11, wherein the processor is configured to vary a velocity of the at least one of the one or more linkages to determine a gradient of power with velocity.

17. The excavator of claim 11, wherein the processor is configured to determine a gradient of power with velocity based at least partly on sensed variations in the one or more operating parameters of the at least one of the one or more linkages from a commanded path of the bucket.

18. The excavator of claim 17, wherein the sensed variations in the one or more operating parameters are sensed with at least one selected from the group of force transducers, current sensors, accelerometers, encoders, pressure transducers, and flow sensors.

19. The excavator of claim 17, wherein the processor is configured to continuously determine the gradient of power with velocity and correct the commanded nominal path during the at least a portion of the digging cycle.

20. The excavator of claim 11, wherein when the commanded nominal path of the bucket passes through a first region of the environment with a first soil property the processor is configured to apply a first correction to the commanded nominal path to maximize the power in the first region, and wherein when the commanded nominal path of the bucket passes through a second region of the environment with a second soil property different from the first soil property, the processor is configured to apply a second correction to the commanded nominal path to maximize the power in the second region.

21. A method of operating an excavator during a digging cycle, the method comprising:

commanding a nominal path of a bucket connected to one or more linkages of the excavator, wherein the commanded nominal path of the bucket passes through a first region with a first soil property and a second region with a second soil property different from the first soil property;

applying a first correction to the commanded nominal path to maximize a power applied by the one or more linkages of the excavator when the bucket passes through the first region; and applying a second correction to the commanded nominal path to maximize the power applied by the one or more linkages of the excavator when the bucket passes through the second region.

22. The method of claim 21, further comprising controlling a velocity of at least one of the one or more linkages based at least partly on a gradient of power with velocity to increase the power applied by the at least one of the one or more linkages.

23. The method of claim 22, further comprising varying the velocity of the at least one of the one or more linkages to determine the gradient of power with velocity.

24. The method of claim 21, wherein the one or more linkages is an arm of the excavator.

25. The method of claim 22, further comprising sensing variations in the applied power and velocity of the one or more linkages from a commanded path of the bucket to determine the gradient of power with velocity.

26. An excavator comprising:

a bucket;

one or more linkages operatively coupled to the bucket;

one or more actuators associated with the one or more linkages;

one or more sensors configured to detect one or more operating parameters of the one or more linkages during a digging cycle;

a processor operatively coupled to the one or more actuators and the one or more sensors, wherein the processor is configured to maximize a power applied by at least one of the one or more linkages during at least a portion of the digging cycle, wherein when the bucket passes through a first region with a first soil property the processor is configured to apply a first correction to a commanded nominal path of the bucket to maximize the power applied in the first region, and wherein when the bucket passes through a second region with a second soil property different from the first soil property the processor is configured to apply a second correction to the commanded nominal path of the bucket to maximize the power applied in the second region.

27. The excavator of claim 26, wherein the processor is configured to control a velocity of the at least one of the one or more linkages based at least partly on a gradient of power with velocity to increase the power applied by the at least one of the one or more linkages.

28. The excavator of claim 26, wherein the at least one of the one or more linkages is an arm of the excavator.

29. The excavator of claim 27, wherein the processor is configured to vary a velocity of the at least one of the one or more linkages to determine the gradient of power with velocity.

30. The excavator of claim 29, wherein the processor is configured to determine the gradient of power with velocity from the commanded path of the bucket based at least partly on sensed variations in the one or more operating parameters of the at least one of the one or more linkages.

* * * * *